US008298736B2

(12) United States Patent
Hirose et al.

(10) Patent No.: US 8,298,736 B2
(45) **Date of Patent: *Oct. 30, 2012**

(54) ELECTROPHOTOGRAPHIC TONER

(75) Inventors: Naohiro Hirose, Tokyo (JP); Hiroyuki Yasukawa, Tokyo (JP); Natsuko Kusaka, Tokyo (JP); Miyuki Murakami, Tokyo (JP); Yohei Ohno, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 706 days.

This patent is subject to a terminal disclaimer.

(21) Appl. No.: 12/467,177

(22) Filed: May 15, 2009

(65) Prior Publication Data

US 2009/0291381 A1 Nov. 26, 2009

(30) Foreign Application Priority Data

May 22, 2008 (JP) ..... 2008-134057

(51) Int. Cl.
*G03G 9/09* (2006.01)

(52) U.S. Cl. ..... 430/108.1; 430/108.2; 430/108.3; 430/108.5; 430/108.21

(58) Field of Classification Search ..... 430/108.1, 430/108.2, 108.3, 108.5, 108.21
See application file for complete search history.

(56) References Cited

U.S. PATENT DOCUMENTS

| | | | | |
|---|---|---|---|---|
| 6,153,345 | A * | 11/2000 | Soeda et al. | 430/108.21 |
| 2006/0292472 | A1 * | 12/2006 | Ono et al. | 430/108.3 |
| 2007/0092819 | A1 * | 4/2007 | Daifuku et al. | 430/108.1 |
| 2007/0207398 | A1 * | 9/2007 | Ono et al. | 430/107.1 |
| 2009/0233207 | A1 * | 9/2009 | Ookubo et al. | 430/108.11 |
| 2009/0233208 | A1 * | 9/2009 | Daifuku et al. | 430/108.15 |
| 2009/0233209 | A1 * | 9/2009 | Daifuku et al. | 430/108.21 |

FOREIGN PATENT DOCUMENTS

| | | |
|---|---|---|
| JP | 2006154363 | 6/2006 |
| JP | 2006267741 | 10/2006 |
| JP | 2007286148 | 11/2007 |
| JP | 2007316591 | 12/2007 |

* cited by examiner

*Primary Examiner* — Hoa V Le

(74) *Attorney, Agent, or Firm* — Lucas & Mercanti, LLP

(57) ABSTRACT

Provided is a toner comprising toner particles containing a binder resin and coloring matters, wherein the coloring matters comprise a dye represented by Formula (X-1), a metal compound represented by Formula (1) and a quinacridone pigment represented by Formula (2):

Formula (X-1)

-continued
Formula (1)
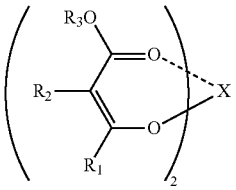
-continued
Formula (2)
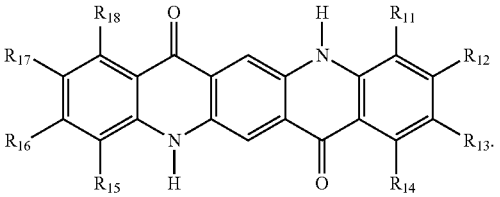
9 Claims, 3 Drawing Sheets

ELECTROPHOTOGRAPHIC TONER

This application is based on Japanese Patent Application No. 2008-134057 filed on May 22, 2008 with Japan Patent Office, the entire content of which is hereby incorporated by reference.

TECHNICAL FIELD

The present invention relates to a toner for an electrostatic charge image development (hereinafter, it is also referred to an electrophotographic toner, or simply, a toner) employed for electrophotographic image formation. More specifically, the present invention relates to a toner which produces an image of superior color hue and exhibits a minimized off-set property in the fixing step of the image formation at a low temperature.

BACKGROUND

In recent years, full color image formation has been practically used in the image formation method of the electrophotography system using an electrostatic charge image development (hereafter, it is called as an electrophotographic toner, or simply called as a toner). Specifically a full color image is formed as follows: the electrostatic latent image corresponding to a manuscript pattern (picture information of a manuscript) is formed by exposing the light separated into spectrum components on a photo conductor; this electrostatic latent image is developed using each color toner, and a plurality of monochromatic toner images is superimposed to form a full color image. The color toners which form a color image are, for example, a yellow toner, a magenta toner and a cyan toner. They containing a binder resin composed of a thermoplastic resin, and a colorant of each color.

Moreover, in recent years, a full color image forming apparatus of an electrophotography system has come to be used by progress of a digital technology, also in the field of small volume printing. That is, full color print production by an electrophotography system has become used to a large extent in the field of small volume printing. In the field of small volume printing, there are many print order opportunities of small-quantity number of sheets. The electrophotography system has an ability of the printing the required number of sheets to be created on demand base, without producing a printing plate which is usually made in conventional printing field (for example, refer to Patent Document 1).

As a colorant which constitutes a color toner, a well-known organic pigment and oil-soluble color can be mentioned conventionally. Heretofore, either an organic pigment or an oil-soluble color has been chosen, or these were mixed and the color toner has been designed.

For a full color image formation, it is required to visually recognize the undermost bottom color on which other colors are superimposed, without being shielded by other colors covered to the bottom color.

The expected toner is to have a sufficient transparency after the color image is fixed. Although the organic pigment is generally excellent in a heat-resisting property or light resistance compared with the oil colors since it exists in the state of dispersion of a grain shape in the toner, the shielding power of the toner will become strong and it has a defect in which the transparency of a toner is reduced. Moreover, since good dispersibility of a pigment is generally hard to acquired, transparency of the toner became still smaller. The pigment has a problem of reducing color saturation of the formed image and good color reproduction is hard to be obtained.

Therefore, in order to visually recognize correctly the undermost bottom color on which other colors are superimposed, without being concealed by the upper colors, the colorant composed of the toner is required to have a good dispersibility and a stable color reproduction property. In producing a full color prints, such as a catalog and an advertisement, with a toner, the employed toner for them is especially required to exhibit faithful color reproduction of the original. That is, in performing full color image formation, when a yellow, magenta, and cyan toner image each are superimposed to a targeted color image, color toners having a good color reproduction property are demanded.

And examination of various colorants has so far been made for the purpose of improving a color reproduction of a color toner. For example, one of the typical magenta colorants for color toners is a quinacridone pigment. Since it has a good magenta color tone and outstanding light resistance, the toner using a quinacridone pigment is used for general-purpose.

However, a quinacridone pigment has a problem in the dispersibility (during toner formation, quinacridone pigments tend to be coagulated and localized in micro-scale) in the inside of a toner, and is easy to generate impure color at the time of a color pile. Therefore, it was difficult to reproduce faithfully the picture on the computer graphics which is high, or a high saturation display picture, which is highly demanded in recent years. Then, an examination to use an additional dye with a quinacridone pigment was carried out aiming at improvement in color saturation (for example, refer to Patent Document 1). Moreover, a technology of having used other pigments together with a quinacridone pigment and performing a toner design was investigated. An example is to use a naphthol pigment with a quinacridone pigment (for example, refer to Patent Document 2). And other example is to use an anthraquinone pigment with a quinacridone pigment (for example, refer to Patent Document 3).

However, each combination which uses these colors and other magenta pigments was inferior in light resistance compared with the case using a quinacridone pigment independently. And when the combination system was used over the long period of time, it had a problem which cannot maintain a stabile color.

Furthermore, the technology of manufacturing a toner by the polymerizing method using the colorant which is composed of a metal compound and a coloring matter as a means to realize image formation of high color saturation also came to be proposed (for example, refer to Patent Documents 4). However, the toner indicated in Patent Documents 4 had a problem of offset property at low temperature at the time of fixing to result in producing a blot at fixing, in spite of having an outstanding hue region and transparency. Therefore, it was difficult for it to perform stable print production over a long period of time.

Patent Document 1: Unexamined Japanese patent application publication (hereafter it is called as JP-A) 2007-286148

Patent Document 1: JP-A 2006-267741

Patent Document 1: JP-A 2006-154363

Patent Document 1: JP-A 2007-316591

SUMMARY

An object of the present invention is to provide a toner which can produce a full color image having a high saturated color without color impurity with high light resistance, and can stably produce a full color image of the outstanding image quality. Specifically, an object of the present invention is to provide a toner which can produce a secondary color of high color saturation and of vividness obtained by superimposing a plurality of monochromatic toner images and can exhibit a minimized offset property at low temperature at the time of fixing.

As a result of diligent investigation, the present inventor finds out the toner which solves the above-mentioned problems and completed the present invention. The toner incorporates a specific colorant, a specific metal compound and a quinacridone pigment.

An aspect of the present invention is a toner comprising toner particles which contain a binder resin, coloring matters comprising a dye represented by Formula (X-1), a metal compound represented by Formula (1) and a quinacridone pigment represented by Formula (2).

Formula (X-1)

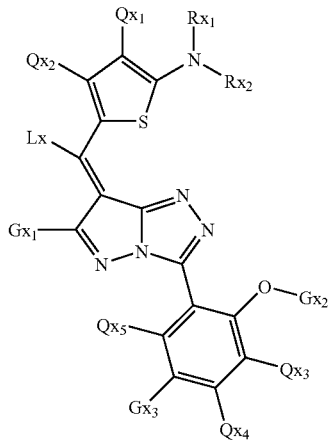

In Formula (X-1), $Rx_1$ and $Rx_2$ each independently represent an alkyl group; Lx represents a hydrogen atom or an alkyl group; $Gx_1$ represents an alkyl group of two or more carbon atoms; $Gx_2$ represents an alkyl group or an aromatic hydrocarbon; $Gx_3$ represents a hydrogen atom, a halogen atom, $Gx_4$-CO—NH—, or $Gx_5$-N($Gx_6$)—CO—, provided that $Gx_4$ is a substituent, and $Gx_5$, $Gx_6$ each independently represents a hydrogen atom or a substituent; and $Qx_1$, $Qx_2$, $Qx_3$, $Qx_4$, and $Qx_5$ each independently represents a hydrogen atom or a substituent.

Formula (1)

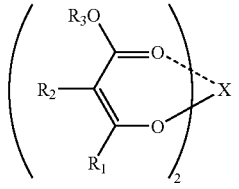

In Formula (1), $R_1$ and $R_2$ each independently represent a hydrogen atom, an alkyl group, an alkenyl group, a alkynyl group, an aryl group, a heterocyclic group, an alkoxycarbonyl group, an aryloxycarbonyl group, a sulfamoyl group, a sulfinyl group, an alkylsulfonyl group, a arylsulfonyl group, a cyano group, a trifluoroalkyl group and a nitro group, provided that one of $R_1$ and $R_2$ is an electron withdrawing group; $R_3$ represents an alkyl group, an alkenyl group, an alkynyl group, an aryl group or a heterocyclic group, provided that a group represented by $R_3$ contains 3 carbon atoms or more; X represents Cu, Ni, or Co. Further, the carbon atoms contained in a ligand of the metal compound represented by Formula (1) is 25 or less.

Formula (2)

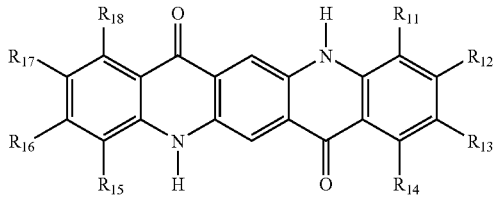

In Formula (2), $R_{11}$ to $R_{18}$ each independently represent a hydrogen atom, an alkyl group, a halogen atom or a methoxy group.

The present invention makes it possible to produce a full color image having a high saturated color without color impurity with high light resistance, and to stably produce a full color image of the outstanding image quality. Specifically, a secondary color image of high color saturation and of vividness can be obtained by superimposing a plurality of monochromatic toner images, and further the toner can exhibit good offset property at low temperature at the time of fixing.

In the present invention, although the reason was not clear, it could produce the secondary color image of high saturation. By combining the metal compound represented by Formula (1), and the dye represented by Formula (X-1) with a quinacridone pigment, it becomes easy to disperse a quinacridone pigment in toner grains. This is considered to be one of the reasons enabling to improve color tone.

Moreover, in the present invention, the offset property at a low temperature at the time of fixing came to be improved. By combining the metal compound represented by Formula (1), and the dye represented by Formula (X-1) with a quinacridone pigment, the surface of the toner image subjected to fixing does not exhibit adhesion to paper. This is considered to be one of the reason that offset property has been improved.

DESCRIPTION OF THE PREFERRED EMBODIMENTS

Figure 1:
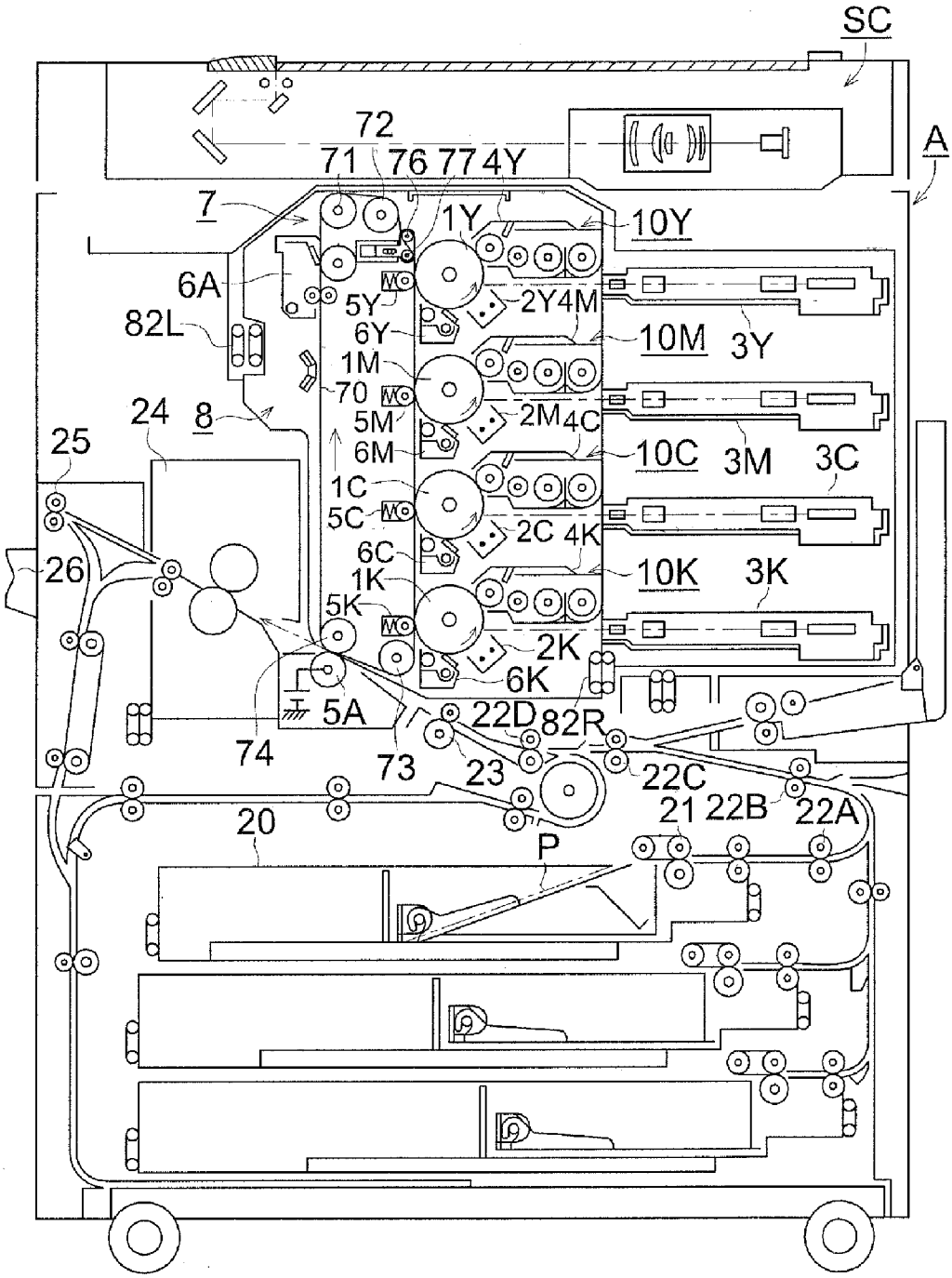
FIG. 1 is a schematic view showing an example of a tandem type full-color image forming apparatus in which image formation of a two-component development system is feasible.

The present invention relates to a toner used for forming an image with an electrophotography system.

The present inventor found that when the toner contains a combination of a metal compound represented by Formula (1), a dye represented by Formula (X-1) and a quinacridone compound represented by Formula (2), the obtained toner image tends to increase adhesion property to other material after the image is fixed. The document off-set property of this toner composition was found to be large. This is due to the effect caused by these metal compounds and coloring matters. That is, since these metal compounds and coloring matters have low molecular weight, solubility to a resin will be increased. As a result, the resin will have a property of plasticizer. And the toner composed of a resin having a property of plasticizer will have a low melting viscosity, consequently, after fixing processing, the surface of the formed image will maintain its softness and it will adhere easily when it touches other papers.

Then, the present inventor tried to decrease the solubility of these compounds to the resin so as to avoid providing the resin with a plasticizer property by these metal compounds or coloring matters. That is, by incorporation of insoluble colorants, such as a pigment, in a toner, a firm interaction could be formed between a metal compound or coloring matters. The present inventor expected that the afore-mentioned problem will be resolved by an introduction of a quinacridone pigment chosen as an insoluble colorant. And present inventor found out that the above-mentioned problem was resolved.

The reason by which the effect of the present invention was realized through combination of the above-mentioned metal compound and coloring matter with a quinacridone pigment is considered as follows. A quinacridone pigment may have a structure which will easily interact with the above-mentioned metal compound and coloring matters.

That is, since a quinacridone pigment has a specific pi conjugated planar structure and has polar groups, such as a carbonyl group and an amino group, it has the structure which may be easy to have an orientation to a metal compound or coloring matters. Therefore, even if an orientation with a metal compound is formed, it still has a possibility to form an orientation with a coloring matter. A quinacridone pigment may form a strong orientation structure between a metal compound and a coloring matter resulting in reducing the effect of a metal compound and a coloring matter to a binder resin.

The present invention will be detailed below.

A dye represented by Formula (X-1) and used in the present invention will be described. A dye represented by Formula (X-1) will also be called as "Compound (X-1)".

Formula (X-1)

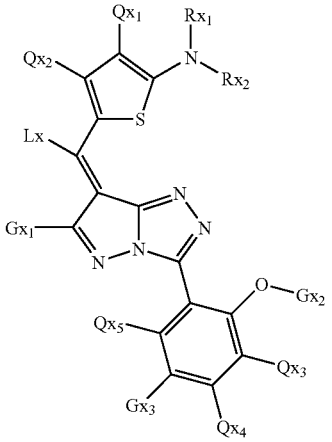

In Formula (1), $Rx_1$ and $Rx_2$ each independently represent an alkyl group; Lx represents a hydrogen atom or an alkyl group; $Gx_1$ represents an alkyl group of 2 or more carbon atoms; $Gx_2$ represents an alkyl group or an aromatic hydrocarbon; $Gx_3$ represents a hydrogen atoms a halogen atom, $Gx_4$-CO—NH—, or $Gx_5$-N($Gx_6$)-CO—, provided that $Gx_5$ and $Gx_6$ each independently represents a hydrogen atom or a substituent; and $Qx_1$, $Qx_2$, $Qx_3$, $Qx_4$, $Qx_5$ each independently represents a hydrogen atom or a substituent.

Here, when $Gx_4$, $Gx_5$ and $Gx_6$ each represent a substituent, they preferably indicate: an alkoxyl group, an aryloxy group, an alkylthio group or an alkoxycarbonyl group. When $Qx_1$, $Qx_2$, $Qx_3$, $Qx_4$ and $Qx_5$ each represent a substituent, they preferably indicate: an alkoxyl group, an aryloxy group, an alkylthio group, an alkoxycarbonyl group or a halogen atom.

As described above, $Rx_1$ and $Rx_2$ each independently represent an alkyl group. Examples of alkyl group are a straight chain alkyl group, a branched alkyl group and a cycloalkyl group. $Rx_1$ and $Rx_2$ may be the same or different alkyl group.

Examples of a straight chain alkyl-group and a branched alkyl group are: a methyl group, an ethyl group, a propyl group, an isopropyl group, n-butyl group, an isobutyl group, a tert-butyl group, a pentyl group, an amyl group, an isoamyl group, a hexyl group, an octyl group, a dodecyl group, a tridecyl group, a tetradecyl group and a pentadecyl group.

Examples of a cycloalkyl group are: a cyclopropyl group, a cyclobutyl group, a cyclopentyl group, a cyclohexyl group and a 4-tert-butylcyclohexyl group. Among these alkyl groups, most preferred are alkyl groups of a straight chain alkyl group and a branched alkyl group.

A preferable compound represented by Formula (X-1) has a total carbon atom number in an alkyl group of $Rx_1$ and an alkyl group $Rx_2$ is equal to 8 or more, more preferably 12 or more, and still more preferably 16 or more.

An alkyl group represented by $Rx_1$ and $Rx_2$ is preferably an unsubstituted alkyl group or an alkyl group substituted with an alkoxyl group, most preferably an unsubstituted alkyl group.

An alkyl group represented by $Rx_1$ and $Rx_2$ may be substituted with an alkoxyl group or other group. Substituents which may be substituted with an alkyl group is not specifically limited. Examples of such substituents include: a straight chain alkyl group, a branched alkyl group and a cycloalkyl group, an alkenyl group, an alkynyl group, an aromatic hydrocarbon group, a heterocyclic group, an alkoxyl group, an aryloxy group, an alkylthio group an arylthio group and an alkoxycarbonyl group.

Examples of an alkenyl group include: a vinyl group and an allyl group. Examples of an alkynyl group include: an ethynyl group and a propargyl group. Examples of an aryl group include: a phenyl group and a naphthyl group.

Examples of an aromatic heterocyclic group include: a furyl group, a thienyl group, a pyridyl group, a pyridazyl group, a pyrimidyl group, a pyrazyl group, a triazyl group, a benzimidazolyl group, a benzoxazolyl group, a pyrazolyl group, a quinazolyl group and a phthalazyl group. Examples of a heterocyclic group include: a pyrrolidyl group, an imidazolidyl group, a morpholyl group and an oxazolidyl group.

Examples of an alkoxyl group include: a methoxy group, an ethoxy group, a propyloxy group, a pentyloxy group, an hexyloxy group, an octyloxy group and a dodecyloxy group. Examples of a cycloalkoxy group include: a cyclopentyloxy group and a cyclohexyloxy group. Examples of an aryloxyl group include: a phenoxy group and a naphthyloxy group.

Examples of an alkylthio group include: a methylthio group, an ethylthio group, a propylthio group, a pentylthio group, a hexylthio group, an octylthio group, and a dodecylthio group. Examples of a cycloalkylthio group include: cyclopentylthio group and a cyclohexylthio group. Examples of an arylthio group include: a phenylthio group and a naphthylthio group.

Examples of an alkoxycarbonyl group include: a methyloxycarbonyl group, an ethyloxycarbonyl group, a butyloxycarbonyl group, an octyloxycarbonyl group, and a dodecyloxycarbonyl group. Examples of an aryloxycarbonyl group include: a phenyloxycarbonyl group and a naphthyloxycarbonyl group.

Examples of a phosphoryl group include: a methoxy phosphoryl group and a diphenyl phosphoryl group. Examples of a sulfamoyl group include: an aminosulfonyl group, a methylaminosulfonyl group, a dimethylaminosulfonyl group, a butylaminosulfonyl group, a hexylaminosulfonyl group, a cyclohexylaminosulfonyl group, an octylaminosulfonyl group, a dodecylaminosulfonyl group, a phenylaminosulfonyl group, a naphthylaminosulfonyl group and a 2-pyridylaminosulfonyl group.

Examples of an acyl group include: an acetyl group, an ethylcarbonyl group, a propylcarbonyl group, a pentylcarbonyl group, a cyclohexylcarbonyl group, an octylcarbonyl group, a 2-ethylhexylcarbonyl group, a dodecylcarbonyl group, a phenylcarbonyl group, a naphthylcarbonyl group and a pyridylcarbonyl group. Examples of an acyloxy group include: an acetyloxy group, an ethylcarbonyloxy group, a butylcarbonyloxy group, an octylcarbonyloxy group, a dodecylcarbonyloxy group and a phenylcarbonyloxy group.

Examples of an amido group include: a methylcarbonylamino group, an ethylcarbonylamino group, a dimethylcarbonylamino group, a propylcarbonylamino group, a pentylcarbonylamino group, a cyclohexylcarbonylamino group, a 2-ethylhexylcarbonylamino group, an octylcarbonylamino group, a dodecylcarbonylamino group, a phenylcarbonylamino group and a naphthylcarbonylamino group.

Examples of a carbamoyl group include: an aminocarbonyl group, a methylaminocarbonyl group, a dimethylaminocarbonyl group, a propylaminocarbonyl group, a pentylaminocarbonyl group, a cyclohexylaminocarbonyl group, an octylaminocarbonyl group, a 2-ethylhexylaminocarbonyl group, a dodecylaminocarbonyl gropup, a phenylaminocarbonyl group, a naphthylaminocarbonyl group and a 2-pyridylaminocarbonyl group.

Examples of a ureido group include: a methylureido group, an ethylureido group, a pentylureido group, a cyclohexylureido group, an octylureido group, a dodecylureido group, a phenylureido group, a naphthylureido group, and a 2-oyridylaminoureido group. Examples of a sulfinyl group include: a methylsulfinyl group, an ethylsulfinyl group, a butylsulfinyl group, a cyclohexylsulfinyl group, a 2-ethylhexylsulfinyl group, a dodecylsulfinyl group, a phenylsulfinyl group, a naphthylsulfinyl group and a 2-pyridylsulfinyl group.

Examples of an alkylsulfonyl group: a methylsulfonyl group, an ethylsulfonyl group, a butylsulfonyl group, a cyclohexylsulfonyl group, a 2-ethylhexylsulfonyl group. Examples of an arylsulfonyl group: a phenylsulfonyl group, a naphthylsulfonyl group and a 2-pyridylsulfonyl group.

Examples of an amino group include: an amino group, an ethylamino group, a dimethylamino group, a butylamino group, a dibutylamino group, a cyclopentylamino group, a 2-ethylhexyl amino group, a dodecylamino group, an anilino group, a naphthylamino group, and a 2-pyridylamino group. Examples of an azo group include a phenylazo group. Examples of an alkylsulfonyloxy group include a methanesulfinyloxy group. Further groups to be cited include: a cyano group; a nitro group; a halogen atom such as a fluorine atom, a chlorine atom and a bromine atom; and a hydroxyl group.

These substituents may be further substituted with other substituents. Preferable substituents which may be further substituted include: in addition to the afore-mentioned alkoxyl group, an aromatic hydrocarbon group, a cycloalkoxy group, a halogen atom and a hydroxyl group.

Lx represents a hydrogen atom or an alkyl group. Among these groups, a hydrogen atom is preferable. When Lx is an alkyl group, this alkyl group is synonymous with an alkyl group represented by $Rx_1$ and $Rx_2$. It is preferable that an alkyl group has 1 to 5 carbon atoms, and a methyl group and an ethyl group are more preferable among these alkyl groups.

$Gx_1$ represents an alkyl group of 2 or more carbon atoms. They may be a straight chain alkyl group, a branched alkyl group and a cycloalkyl group. Examples of a straight chain alkyl group and a branched alkyl group include: an ethyl group, a propyl group, an isopropyl group, n-butyl group, an isobutyl group, a tert-butyl group, a pentyl group, an amyl group, an isoamyl group, a hexyl group, an octyl group, a dodecyl group, a tridecyl group, a tetradecyl group, a pentadecyl group. Examples of a cycloalkyl group include: a cyclopropyl group, a cyclobutyl group, a cyclopentyl group, a cyclohexyl group and a 4-tert-butylcyclohexyl group. Among them a branched alkyl group is preferred, and a tert-butyl group is most preferred.

$Gx_2$ represents an alkyl group or an aromatic hydrocarbon group; an alkyl group is synonymous with an alkyl group represented by $Rx_1$ and $Rx_2$; and examples of an aromatic hydrocarbon group include a phenyl group and a naphthyl group. Among these groups, an alkyl group is preferable. More preferred is an alkyl group of 1 to 5 carbon atoms, and specifically preferred are a methyl group and an ethyl group.

$Gx_3$ represents a hydrogen atom, a halogen atom or $Gx_4$-CO—NH—, $Gx_5$-N($Gx_6$)-CO—. Among them, a hydrogen atom is preferable. $Gx_4$ represents a substituent, examples of which are the same substituents that may be substituted with an alkyl group represented by $Rx_1$ and $Rx_2$. Preferable substituents are the same alkyl group represented by $Rx_1$ and $Rx_2$ or an aromatic hydrocarbon group.

$Gx_5$ and $Gx_6$ each represent a hydrogen atom or a substituent. Examples of a substituent are the same substituents that may be substituted with an alkyl group represented by $Rx_1$ and $Rx_2$. Preferable substituents are the same alkyl group represented by $Rx_1$ and $Rx_2$.

$Qx_1$, $Qx_2$, $Qx_3$, $Qx_4$ and $Qx_5$ each independently represent a hydrogen atom or a substituent. Examples of a substituent are the same as $Gx_4$. It is preferable that $Qx_1$, $Qx_2$, $Qx_3$, $Qx_4$ and $Qx_5$ each independently represent a hydrogen atom, an alkyl group, a halogen atom or an alkoxyl group. It is more preferable the all of $Qx_1$, $Qx_2$, $Qx_3$, $Qx_4$ and $Qx_5$ are a hydrogen atom.

Examples of a compound represented by Formula (X-1) are shown below, however, the compounds which can be usable in the present invention are not limited b them.

DX-1

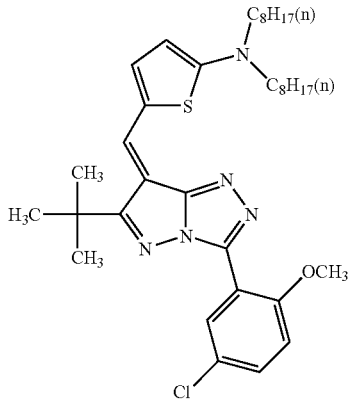

-continued
DX-2
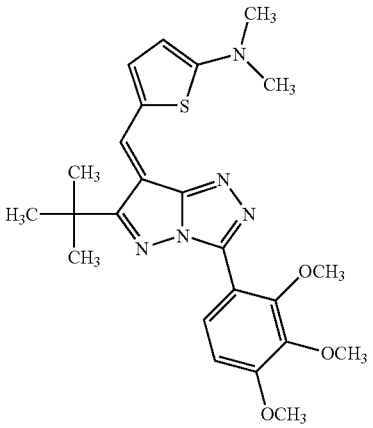
DX-3
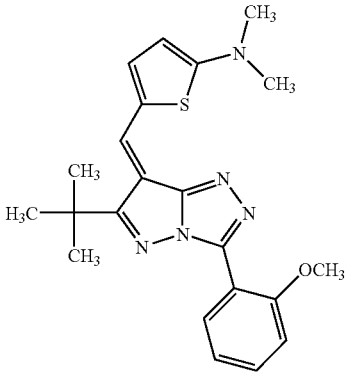
DX-4
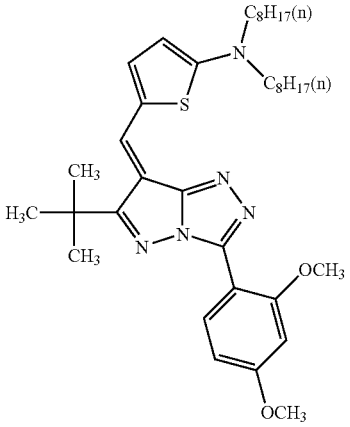
DX-5
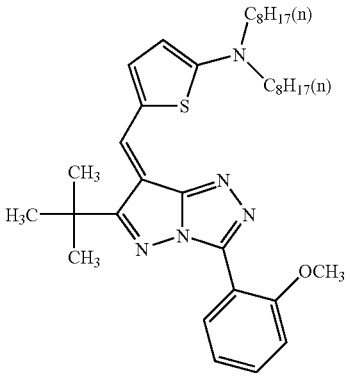
-continued
DX-6
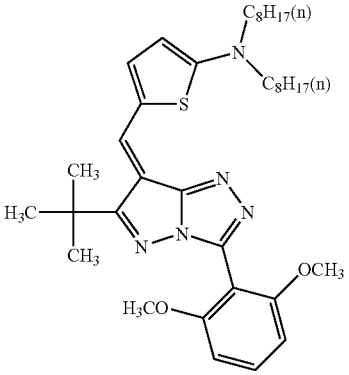
DX-7
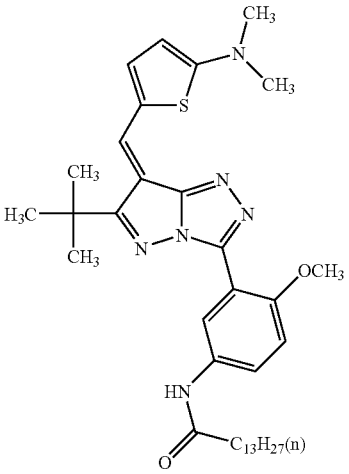
DX-8
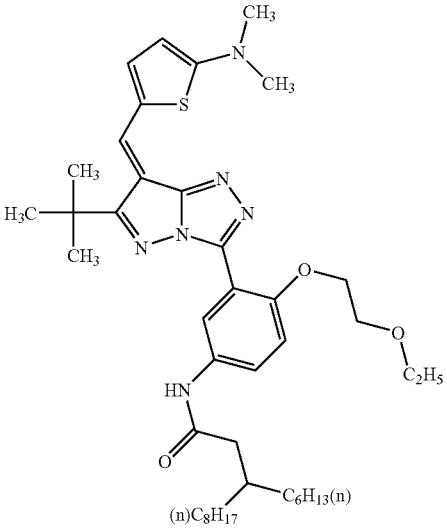

-continued
DX-9
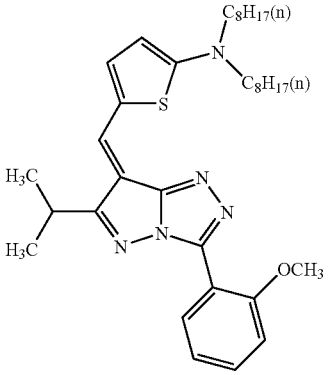
DX-10
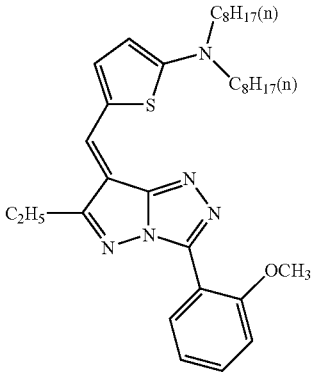
DX-11
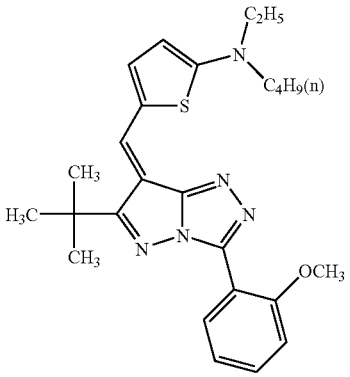
DX-12
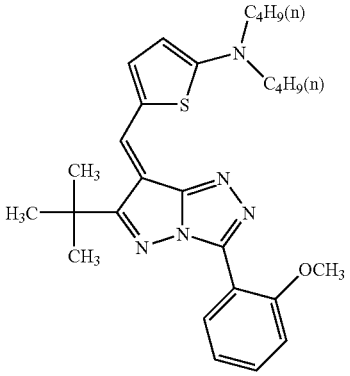
-continued
DX-13
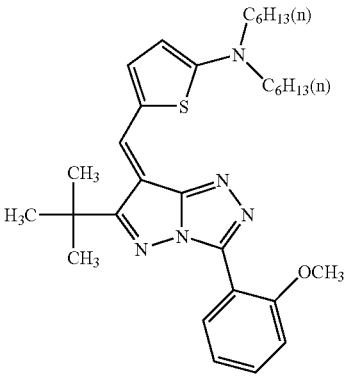
DX-14
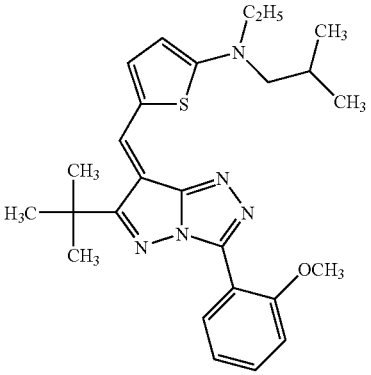
DX-15
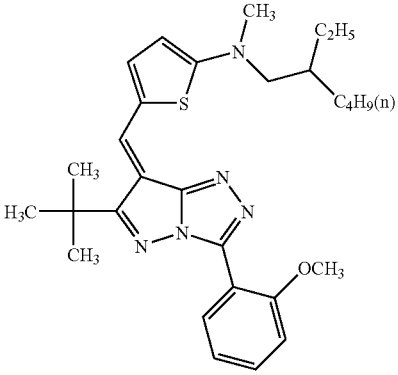
DX-16
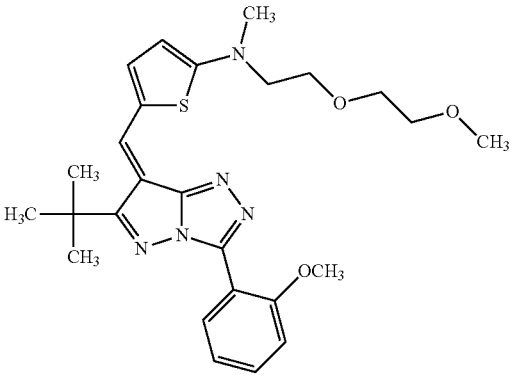

-continued
DX-17
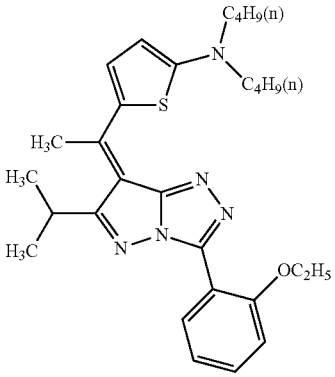
DX-18
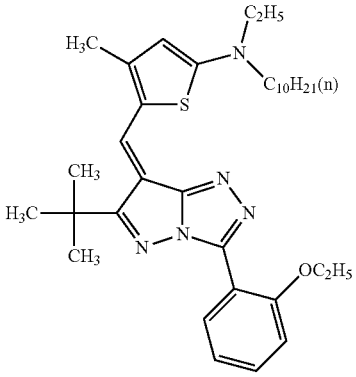
DX-19
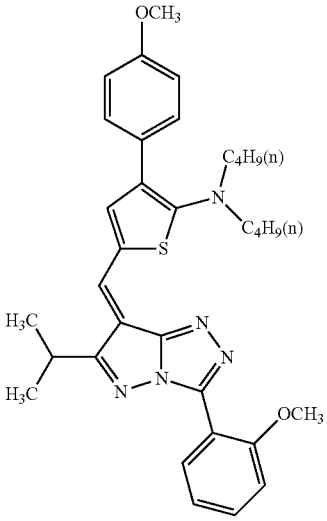
-continued
DX-20
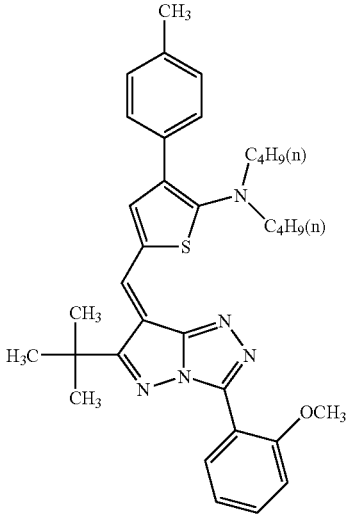
DX-21
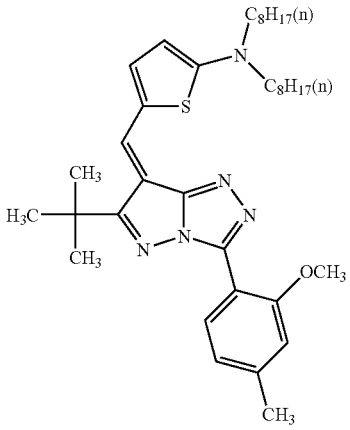
DX-22
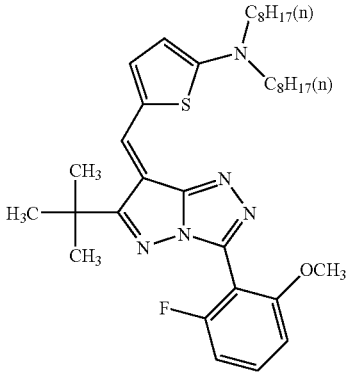

-continued

DX-23

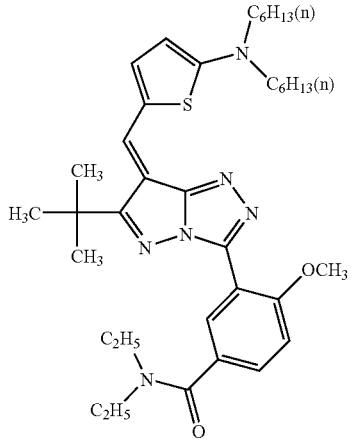

A metal compound represented by the following Formula (1) will be described. Formula (1)

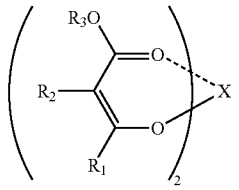

$R_1$ and $R_2$ that constitute a compound represented by Formula (1) each independently represent a hydrogen atom or a substituent. Examples of a substituent include: an alkyl group, an alkenyl group, a alkynyl group, an aryl group, a heterocyclic group, an alkoxycarbonyl group, an aryloxycarbonyl group, a sulfamoyl group, a sulfinyl group, an alkylsulfonyl group, a arylsulfonyl group, a cyano group, a trifluoroalkyl group and a nitro group. One of $R_1$ and $R_2$ is an electron withdrawing group. $R_3$ represents an alkyl group, an alkenyl group, an alkynyl group, an aryl group or a heterocyclic group, provided that a group represented by $R_3$ contains 3 carbon atoms or more. The carbon atoms contained in a ligand of the metal compound represented by Formula (1) is 25 or less.

Specific examples for R that constitutes a metal compound represented by Formula (1) will be described below.

Examples of an alkyl group include: a methyl group, an ethyl group, a propyl group, an isopropyl group, a tert-butyl group, a pentyl group, a hexyl group, an octyl group, a dodecyl group, a tridecyl group, a tetradecyl group and a pentadecyl group.

Examples of a trifluoroalkyl group include: a trifluoromethyl group, a trifluoroethyl group and trifluoropropyl group.

Examples of a cycloalkyl group include: a cyclopentyl group and a cyclohexyl group. Examples of an alkenyl group include: a vinyl group and an allyl group.

Examples of an alkynyl group include: an ethynyl group and a propargyl group. Examples of an aryl group include: a phenyl group and a naphthyl group.

Examples of an aromatic heterocyclic group include: a furyl group, a thienyl group, a pyridyl group, a pyridazyl group, a pyrimidyl group, a pyrazyl group, a triazyl group, an imidazolyl group, a pyrazolyl group, a thiazolyl group, a benzimidazolyl group, a benzoxazolyl group, a quinazolyl group and a phthalazyl group.

Examples of a heterocyclic group include: a pyrrolidyl group, an imidazolidyl group, a morpholyl group and an oxazolidyl group.

Examples of an alkoxyl group include: a methoxy group, an ethoxy group, a propyloxy group, a pentyloxy group, an hexyloxy group, an octyloxy group and a dodecyloxy group.

Examples of a cycloalkoxy group include: a cyclopentyloxy group and a cyclohexyloxy group.

Examples of an aryloxyl group include: a phenoxy group and a naphthyloxy group. Examples of an alkylthio group include: a methylthio group, an ethylthio group, a propylthio group, a pentylthio group, a hexylthio group, an octylthio group, and a dodecylthio group.

Examples of a cycloalkylthio group include: cyclopentylthio group and a cyclohexylthio group. Examples of an arylthio group include: a phenylthio group and a naphthylthio group.

Examples of an alkoxycarbonyl group include: a methyloxycarbonyl group, an ethyloxycarbonyl group, a butyloxycarbonyl group, an octyloxycarbonyl group, and a dodecyloxycarbonyl group. Examples of an aryloxycarbonyl group include: a phenyloxycarbonyl group and a naphthyloxycarbonyl group.

Examples of a sulfamoyl group include: an aminosulfonyl group, a methylaminosulfonyl group, a dimethylaminosulfonyl group, a butylaminosulfonyl group, a hexylaminosulfonyl group, a cyclohexylaminosulfonyl group, an octylaminosulfonyl group, a dodecylaminosulfonyl group, a phenylaminosulfonyl group, a naphthylaminosulfonyl group and a 2-pyridylaminosulfonyl group.

Examples of an acyl group include; an acetyl group, an ethylcarbonyl group, a propylcarbonyl group, a pentylcarbonyl group, a cyclohexylcarbonyl group, an octylcarbonyl group, a 2-ethylhexylcarbonyl group, a dodecylcarbonyl group, a phenylcarbonyl group, a naphthylcarbonyl group and a pyridylcarbonyl group.

Examples of an acyloxy group include: an acetyloxy group, an ethylcarbonyloxy group, a butylcarbonyloxy group, an octylcarbonyloxy group, a dodecylcarbonyloxy group and a phenylcarbonyloxy group.

Examples of an amido group (a carbonylamino group) include: a methylcarbonylamino group, an ethylcarbonylamino group, a dimethylcarbonylamino group, a propylcarbonylamino group, a pentylcarbonylamino group, a cyclohexylcarbonylamino group, a 2-ethylhexylcarbonylamino group, an octylcarbonylamino group, a dodecylcarbonylamino group, a phenylcarbonylamino group and a naphthylcarbonylamino group.

Examples of a carbamoyl group include: an aminocarbonyl group, a methylaminocarbonyl group, a dimethylaminocarbonyl group, a propylaminocarbonyl group, a pentylaminocarbonyl group, a cyclohexylaminocarbonyl group, an octylaminocarbonyl group, a 2-ethylhexylaminocarbonyl group, a dodecylaminocarbonyl gropup, a phenylaminocarbonyl group, a naphthylaminocarbonyl group and a 2-pyridylaminocarbonyl group.

Examples of a ureido group include; a methylureido group, an ethylureido group, a pentylureido group, a cyclohexylureido group, an octylureido group, a dodecylureido group, a phenylureido group, a naphthylureido group, and a 2-oyridylaminoureido group.

Examples of a sulfinyl group include: a methylsulfinyl group, an ethylsulfinyl group, a butylsulfinyl group, a cyclohexylsulfinyl group, a 2-ethylhexylsulfinyl group, a dodecylsulfinyl group, a phenylsulfinyl group, a naphthylsulfinyl group and a 2-pyridylsulfinyl group.

Examples of an alkylsulfonyl group: a methylsulfonyl group, an ethylsulfonyl group, a butylsulfonyl group, a cyclohexylsulfonyl group, a 2-ethylhexylsulfonyl group.

Examples of an arylsulfonyl group: a phenylsulfonyl group, a naphthylsulfonyl group and a 2-pyridylsulfonyl group.

Examples of an amino group include: a methylamino group, an ethylamino group, a dimethylamino group, a butylamino group, a cyclopentylamino group, 2-ethylhexylamino group, a dodecylamino group, an anilino group, a naphthylamino group, and a 2-pyridylamino group.

Further groups which can be used as a substituent include: a cyano group; a nitro group; a halogen atom (such as a fluorine atom, a chlorine atom and a bromine atom). These groups may be further substituted with a similar substituent.

Among these groups, preferable groups are: an alkyl group, a trifluoroalkyl group, an aryl group, a heterocyclic group, a hetero aryl group, an alkoxy group, a sulfamoyl group, an ureido group, an amino group, an amide group, an acyl group, an alkoxycarbonyl group, a carbamoyl group, a cyano group and a halogen atom.

More preferable groups are: an alkyl group, a trifluoroalkyl group, a cyano group, an alkoxy group, an amide group, and a halogen atom. And particularly preferable groups are: a trifluoroalkyl group, a cyano group, an alkoxy group.

Metal atom X in Formula (1) represents: Cu, Co, or Ni. Among them, Cu is most preferable.

Representative metal compounds represented by Formula (1) are shown below, however, the metal compounds usable in the present invention are not limited to them. The shown structures are only one of the tautomeric structures that may be taken by the exemplified compounds. The discrimination between the covalent bonds indicated by the solid lines and the coordinate covalent bond indicated by the dotted lines is merely formal and it does not represent an absolute discrimination.

1-1

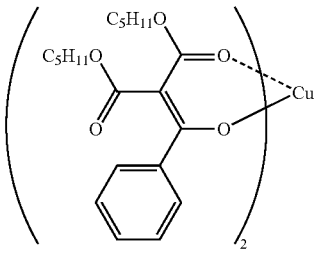

1-2

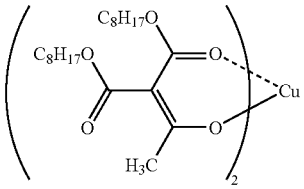

1-3

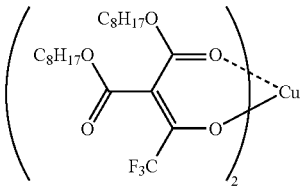

-continued 1-4

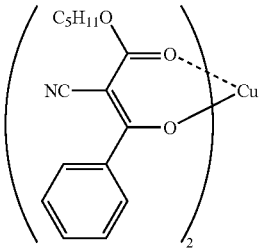

1-5

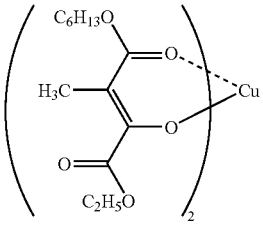

1-6

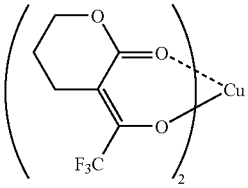

1-7

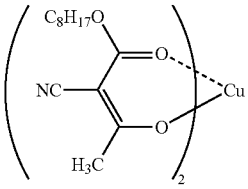

1-8

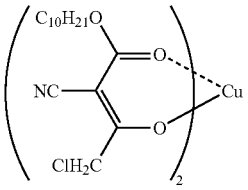

1-9

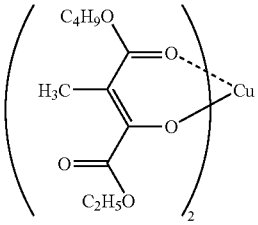

I-10

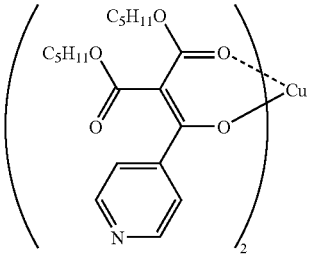

-continued
1-11
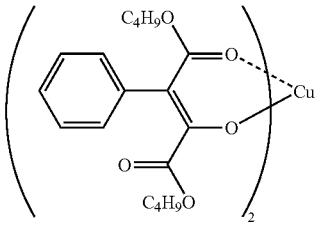
1-12
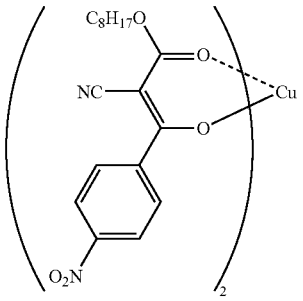
1-13
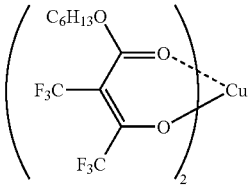
1-14
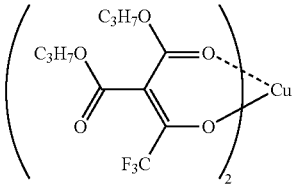
1-15
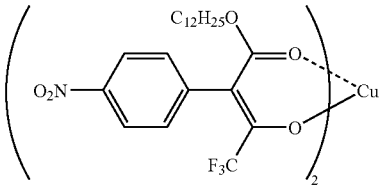
1-16
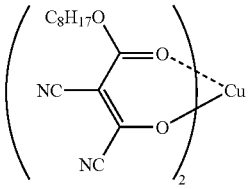
1-17
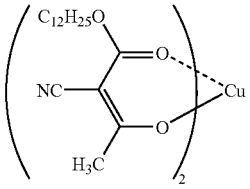
-continued
1-18
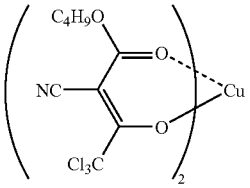
1-19
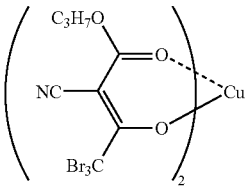
1-20
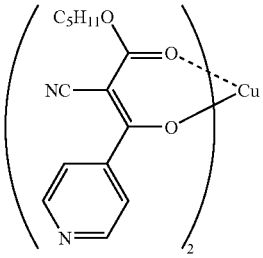
1-21
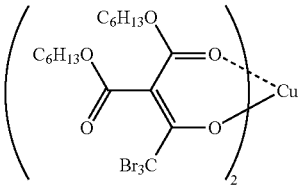
1-22
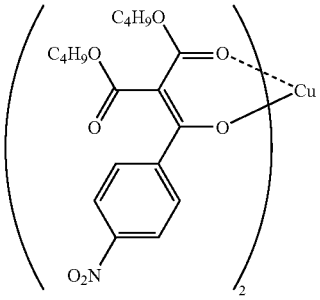
1-23
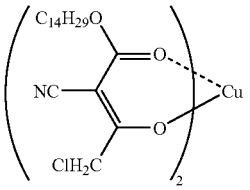
1-24
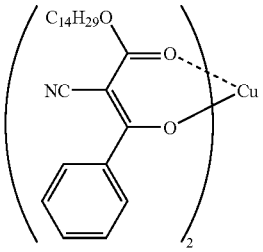

-continued
1-25
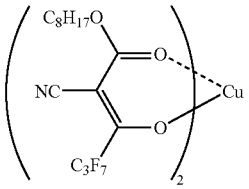
1-26
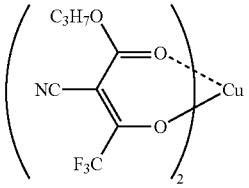
1-27
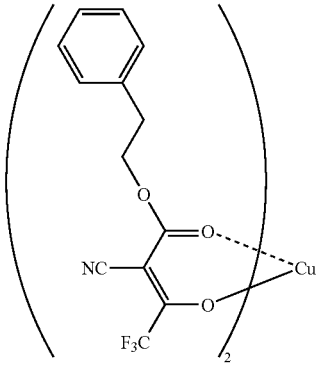
1-28
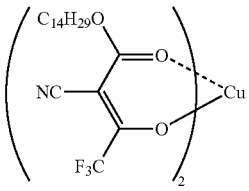
1-29
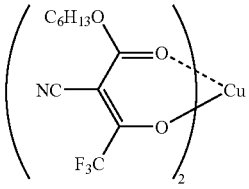
1-30
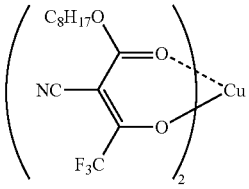
1-31
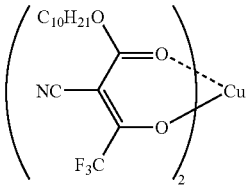
-continued
1-32
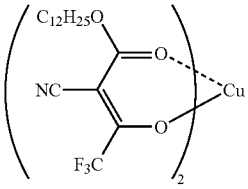
1-33
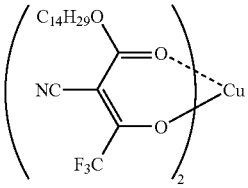
1-34
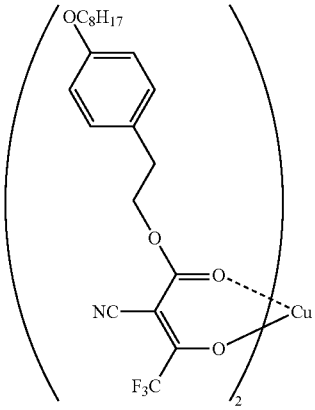
1-35
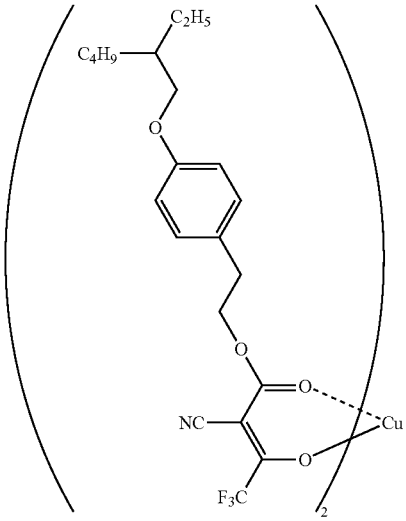

-continued
1-36
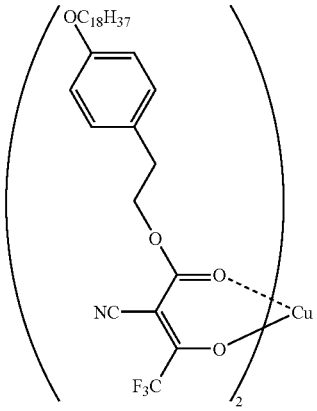
1-37
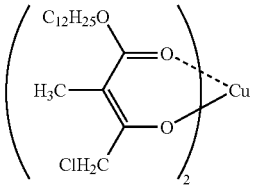
1-38
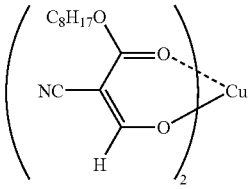
1-39
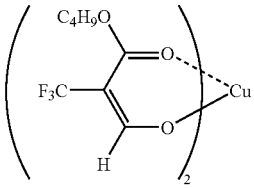
1-40
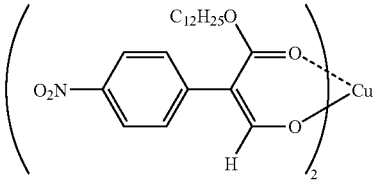
1-41
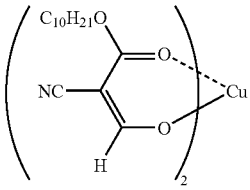
1-42
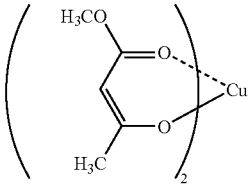
-continued
1-43
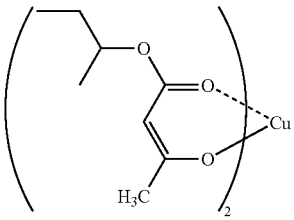
1-44
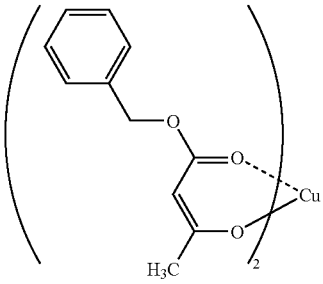
1-45
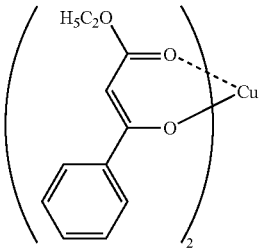
1-46
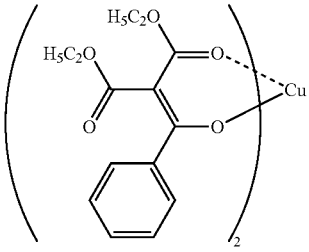
1-47
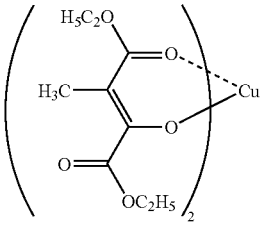
1-48
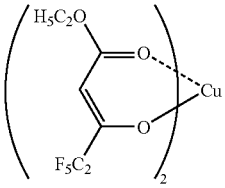

-continued
1-49
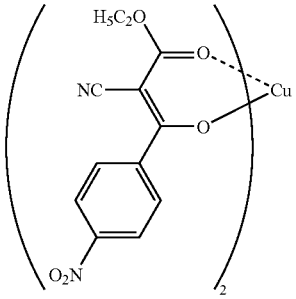
1-50
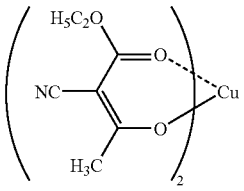
1-51
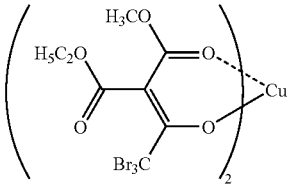
1-52
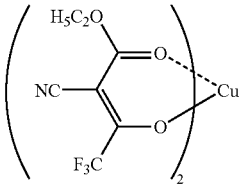
1-53
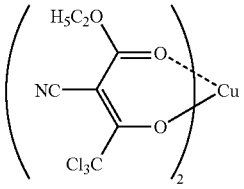
1-54
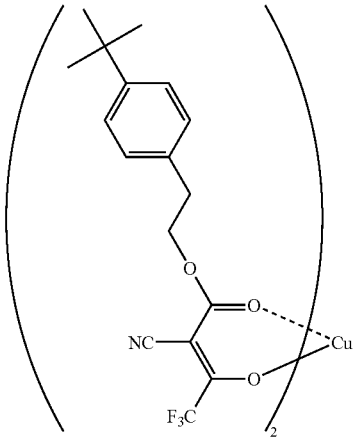
-continued
1-55
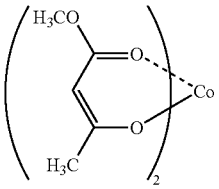
1-56
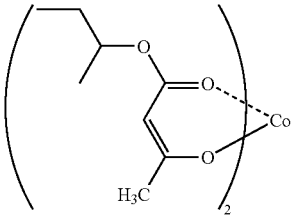
1-57
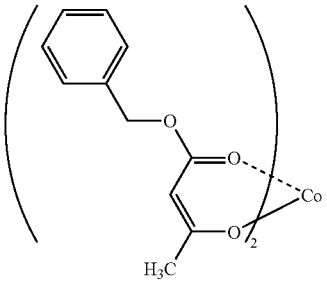
1-58
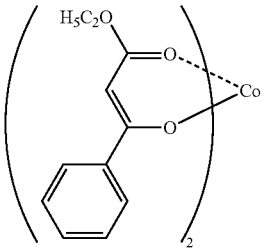
1-59
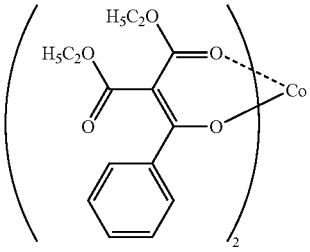
1-60
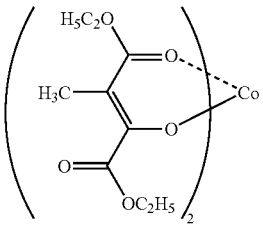

-continued
1-61
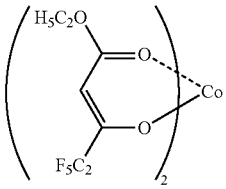
1-62
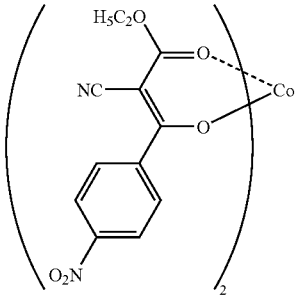
1-63
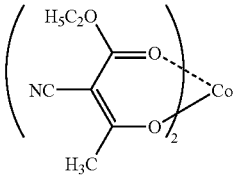
1-64
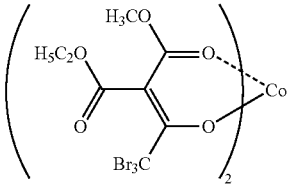
1-65
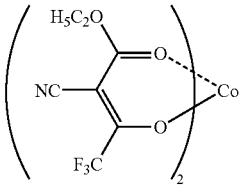
1-66
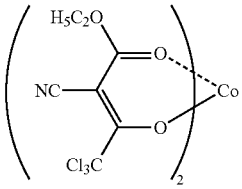
-continued
1-67
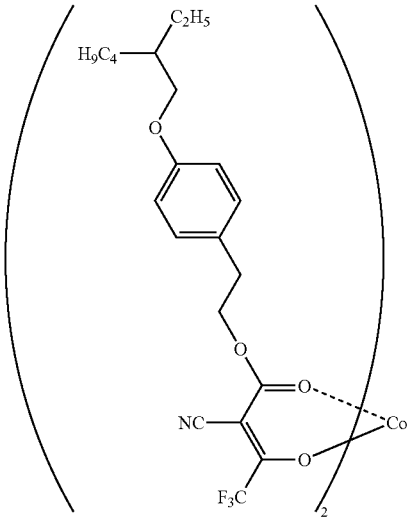
1-68
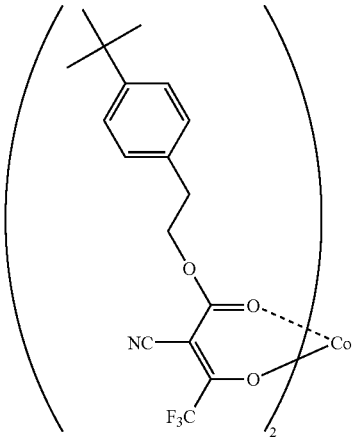
1-69
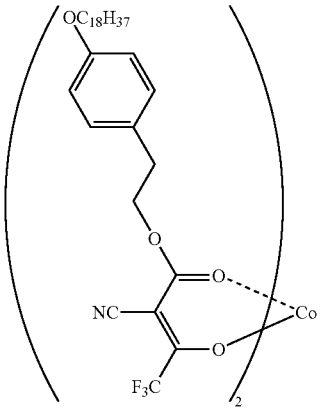
1-70
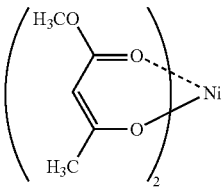

-continued
1-71
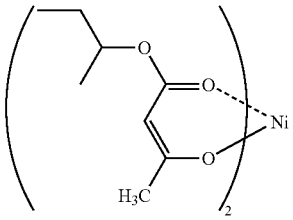
1-72
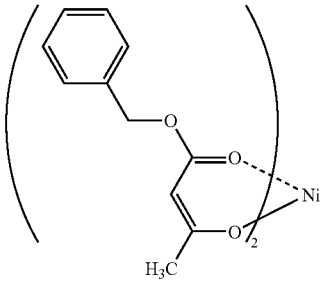
1-73
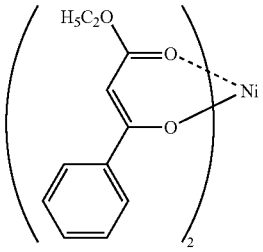
1-74
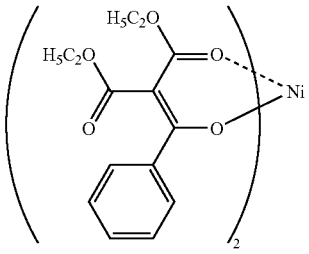
1-75
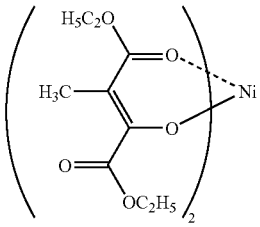
1-76
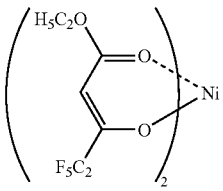
-continued
1-77
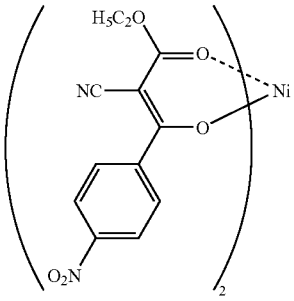
1-78
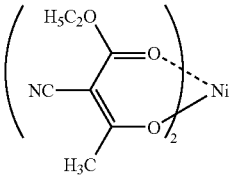
1-79
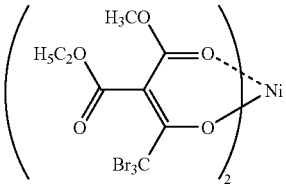
1-80
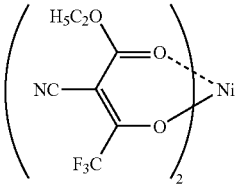
1-81
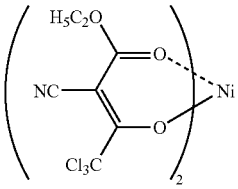
1-82
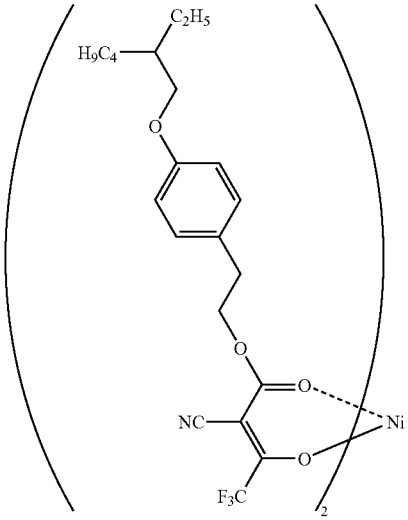

-continued 1-83

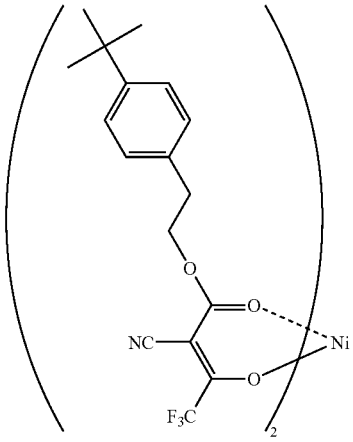

1-84

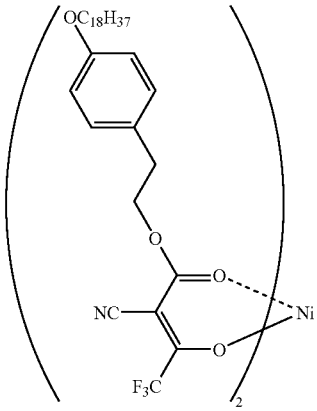

In the present invention, the metal compounds represented by Formula (1) may be employed individually or in combinations of at least two types. When the added amount of the compounds represented by Formula (1) is regulated to 0.8-3 times mol or preferably to 1-2 times mol with respect to the dyes represented by Formula (X-1) it is possible to enhance the lightfastness and dispersion stability of the dyes.

The quinacridone pigments represented by following Formula (2) will now be described.

Formula (2)

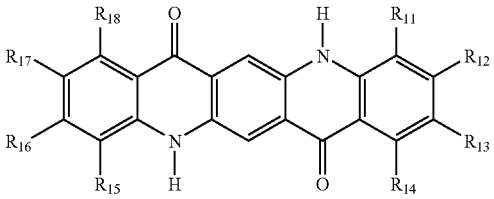

$R_{11}$-$R_{18}$, which constitute the quinacridone pigments represented by Formula (2), each independently represents a hydrogen atom, an alkyl group, a halogen group, or a methoxy group.

The quinacridone compounds employed in the present invention are not particularly limited, and prior art quinacridone compounds listed below may be employed. Specific examples of quinacridone pigments include:

(1) dimethylquinacridone pigments such as C.I. Pigment Red 122, (2) dichloroquinacridone pigments such as C.I. Pigment Red 202 or C.I. Pigment Red 209, (3) unsubstituted quinacridone pigments such as C.I. Pigment Violet 19, and (4) mixtures or solid solutions of at least two types which are selected from the aforesaid quinacridone pigments.

Of the aforesaid quinacridone compounds, preferred is Pigment Red 122. Further, employed quinacridone compounds may be in a dry state such as a powder, granules or bulk, or in a wet state such as a wet cake or slurry.

Specific examples of the quinacridone pigments employed in the present invention will now be listed below, however quinacridone pigments, which may be employed in the present invention, are not limited thereto.

(2-1)

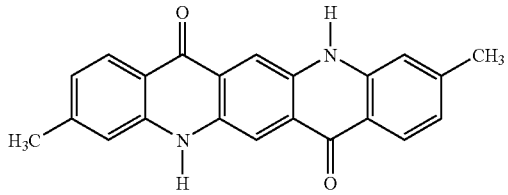

(2-2)

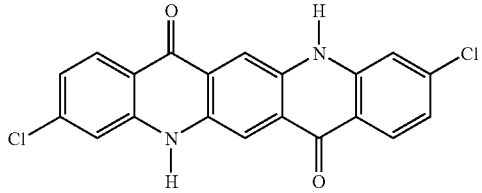

(2-3)

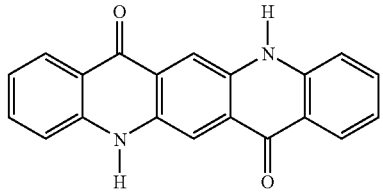

(2-4)

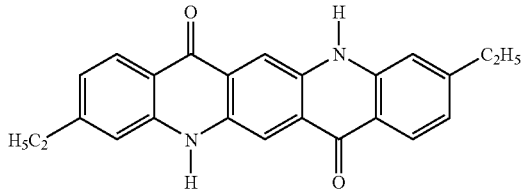

(2-5)

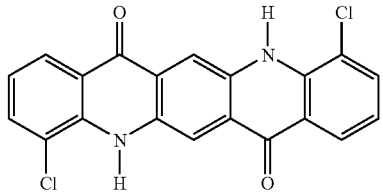

(2-6)

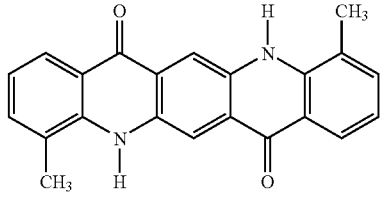

-continued (2-7)

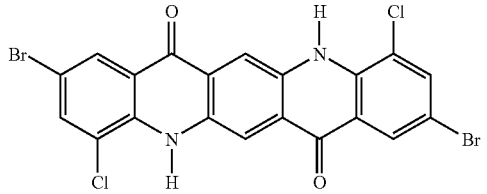

(2-8)

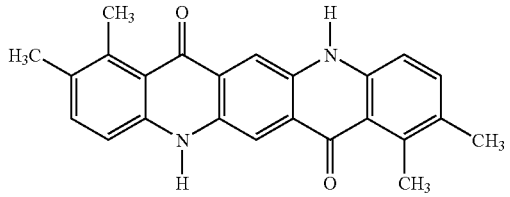

(2-9)

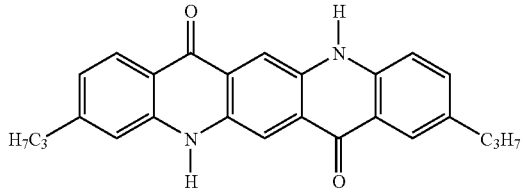

(2-10)

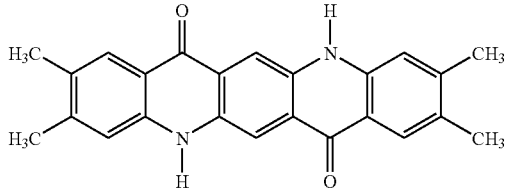

(2-11)

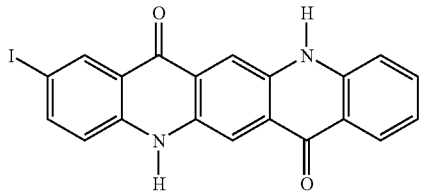

(2-12)

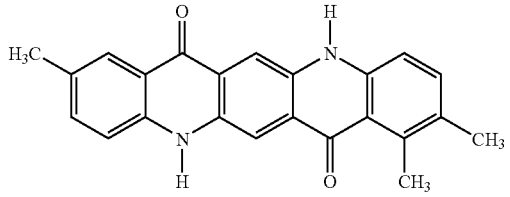

Although the added amount of a metal compound represented by Formula (1), a dye represented by Formula (X-1), and a quinacridone pigment represented by Formula (2) each are not specifically limited. But it is preferable that the total amount of these compounds is in the range of 2-20 mass % based on the total mass of the toner. Furthermore, it is more preferable to control the added amount of a metal compound, a dye and a quinacridone pigment into the range of 0.5-10 mass % to the whole toner, and still more preferably to control the added amount of a metal compound, dye and a quinacridone pigment within the range of 1-7 mass %.

Moreover, in order to make an effect more remarkable in the present invention, the ratio of a metal compound to a dye is controlled in a predetermined ratio. When the total amount of a metal compound and a dye is made into 100 mass parts, it is desirable that a quinacridone pigment is made to be 5 to 150 mass parts. By setting the ratio of these compounds into the above-mentioned range, the orientation structure by a metal compound and a dye is certainly formed centering on a quinacridone pigment, and the solubility to resin of a metal compound and a dye can be controlled. Thus, since an orientation structure of a metal compound and dye between a quinacridone pigment will form without fail by adjusting the ratio of a quinacridone pigment. A metal compound and a dye without forming an orientation structure with will not be allowed. Consequently, these compounds do not give plasticizing property to a binder resin. As a result, it is thought that the separation of a toner image at fixing will be improved.

On the other hand, it is thought by appropriately adjusting the added amount of a quinacridone pigment the transparency of a toner image is also maintained and color reproduction property can be secured in the large range as well as improvement in separation of the image at fixing process.

The toner according to the present invention may also contain other well-known dyes together, in addition to a coloring matter expressed with Formula (X-1), a metal compound expressed with Formula (1) and a quinacridone pigment expressed with Formula (2). A preferable well-known colorant which can be used is an oil-soluble colorant.

The physical properties of the toner according to the present invention will be described.

The toner particles in the toner of the present invention preferably have a volume based median diameter ($D50_v$) from 3 to 8 μm. By controlling the volume based median diameter of the toner particles within the range as mentioned above, the toner composed of a dye represented by Formula (X-1), a metal compound represented by Formula (1) and a quinacridone pigment represented by Formula (2) will be provided with a possibility to produce a larger range of color reproduction.

The volume based median diameter ($D50_v$) of the toner particles of the present invention can be measured and determined employing a size distribution measurement instrument, "COULTER MULTISIZER 3" (produced by Beckman-Coulter Co.) connected with a computer system (produced by Beckman-Coulter Co.) for data processing.

Measurement procedures are as follows. After allowing to soak 0.02 g of toner with 20 ml of a surface active agent solution (for example, a surface active agent solution, aimed at dispersing the toner), which is prepared by diluting a neutral detergent incorporating surface active agent components by a factor of 10), the mixture is subjected to microwave dispersion for one minute, whereby a toner dispersion is prepared.

The resulting toner dispersion is injected into a beaker carrying ISOTON II (produced by Beckman-Coulter Co.) in the sample stand until reaching a measurement concentration of 8% by weight. By controlling the concentration to this range, a high reproducible measurement value can be obtained. And measurement is carried out while setting the count of the instrument at 2,500 and the employed aperture diameter of 50 μm. The measuring range of 1 to 30 μm is divided into 256 sections and a frequency value in each section is calculated. The volume based median diameter ($D50_v$) is a particle diameter at which 50% of a volume ratio is achieved when each volume is integrated from a large sized particle to a small sized particle.

The toner particles in the toner of the present invention preferably have a coefficient of variation (CV value) of a volume based particle diameter distribution in the range of 5% to 31%, and more preferably from 10% to 25%.

A coefficient of variation (CV value) of a volume based particle diameter distribution is a value obtained from (A) standard deviation in the volume based particle distribution by dividing (B) median diameter ($D50_v$) in the volume based particle distribution (A/B) and then multiplying by 100. This value can be obtained from the following scheme (1). indicates a degree of distribution of a volume based toner particles size and calculated by the following Equation (1). When the CV value is small, it means that the particle diameter distribution is narrow, hence, the size of the toner particles is uniform.

*CV* value (%) of a volume based particle diameter distribution=((standard deviation in the volume based particle distribution)/(median diameter ($D50_v$) in the volume based particle distribution))×100. Equation (1)

By controlling the CV value within the range as described above, the toner particles become uniform in volume size. The difference in melting property of the toner particles can be minimized As a consequence, a toner image can be uniformly melted and adhered. It is possible to reliably reproduce a vivid toner image having a high saturation with the toner composed of a combination of the aforementioned dye, metal compound and quinacridone pigment.

The toner of the present invention contains preferably toner particles having an average circularity defined by the following Equation (2) of 0.930 to 1000, and more preferably, of 0.950 to 0.995 from the viewpoint of increasing transferring efficiency.

Average circularity=(circumferential length of a circle having the same projective area as that of a particle image)/(circumferential length of the projective particle image) Equation (2)

The toner particles in the toner of the present invention have preferably a softening point ($T_{sp}$) of from 70 to 120° C., and more preferably from 70 to 110° C.

By setting the softening point to be within the above-described range, deterioration which may be induced by the heat applied during fixing can be decreased. As a consequence, an image can be formed without imposing undue thermal stress to the components of the aforementioned dye, metal compound and quinacridone pigment. As a result, a vivid color image having a wide and stable color reproduction property can be reliably produced. Further, due to the tact that a vivid color image having a wide and stable color reproduction property can be produced by setting the fixing temperature lower than conventional fixing temperature, electric power consumption required for image will be decreased and reduced environmental load can be achieved.

The softening point of a toner can be controlled by the following methods, singly or in combination;

(1) the kind or the composition of monomer used for resin formation is adjusted;

(2) the molecular weight of a resin is controlled by the kind or the amount of a chain-transfer agent; and (3) the kind or amount of a wax is controlled.

The softening point can be controlled by appropriately combining the methods (1) to (3).

The softening point of a toner may be measured by using, for example, Flow Tester CFT-500 (produced by Shimazu Seisakusho Co., Ltd.). Specifically, a sample which is molded to a 10 mm high column, is compressed by a plunger at a load of $1.96\times10^6$ Pa with heating at a temperature rising rate of 6° C./min and extruded from a long nozzle having a diamante of 1 mm and a length of 1 mm, whereby, a curve (softening flow curve) between plunger-drop and temperature is drawn. The temperature at which flowing-out is initiated is defined as the fusion-initiation temperature and the temperature corresponding to 5 mm drop is defined as the softening temperature.

Next, there will be described resin and wax constituting the toner of the invention, with reference to examples.

Resins usable for the toner of the invention are not specifically limited but are typically polymers formed by polymerization of polymerizable monomers which are called vinyl monomers. A polymer constituting a resin usable in the invention is constituted of a polymer obtained by polymerization of at least one polymerizable monomer, which is a polymer prepared by using vinyl monomers singly or in combination.

Specific examples of a polymerizable vinyl monomer are below:

(1) styrene or styrene derivatives:
styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene;

(2) methacrylic acid ester derivatives:
methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) acrylic acid ester derivatives:
methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate;

(4) olefins:
ethylene, propylene and isobutylene;

(5) vinyl esters:
vinyl propionate, vinyl acetate and vinyl benzoate;

(6) vinyl ethers:
vinyl methyl ether and vinyl ethyl ether;

(7) vinyl ketones:
vinyl methyl ketone, vinyl ethyl ketone and vinyl hexyl ketone;

(8) N-vinyl compounds:
(N-vinyl carbazole, N-vinyl indole and N-vinyl pyrrolidone;

(9) others:
vinyl compounds such as vinylnaphthalene and vinylpyridine; acrylic acid or methacrylic acid derivatives such as acrylonitrile, methacrylonitrile and acrylamide.

There may also usable polymerizable monomers containing ionic-dissociative group, as a vinyl monomer, and including, for example, those having a side chain containing a functional group such as a carboxyl group, a sulfonic acid group or a phosphoric acid group. The dye of the present invention has a weak alkaline property as mentioned above, as a result, combining with the aforementioned monomer is preferable because it will improve the degree of dispersion of the dye in the resin.

Specific examples include carboxyl group containing monomers such as acrylic acid, methacrylic acid, maleic acid, itaconic acid, cinnamic acid, fumaric acid, monoalkyl maleate, monoalkyl itaconate; sulfonic acid group containing monomers such as styrenesulfonic acid, allylsulfosuccinic acid, 2-acrylamido-2-methylpropanesulfonic acid; and phosphoric acid group containing monomers such as acid phosphooxyethyl methacrylate.

Further, a cross-linked resin can be obtained using poly-functional vinyl compounds. Examples of such poly-functional vinyl compounds are shown below.

Examples of a poly-functional vinyl compound include: divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

The toner of the present invention contains a wax with a resin and the aforementioned dye. Examples of a was include:

(1) polyolefin wax such as polyethylene wax and polypropylene wax;
(2) long chain hydrocarbon wax such as paraffin wax and sasol wax and microcrystalline wax;
(3) dialkyl ketone type wax such as distearyl ketone;
(4) ester type wax such as carnauba wax, montan wax, trimethylolpropane tribehenate, pentaerythritol tetramyristate, pentaerythritol tetrabehenate, pentaerythritol diacetate dibehenate, behenyl behanate, glycerin tribehenate, 1,18-octadecanediol distearate, trimellitic acid tristearate, and distearyl meleate; and
(5) amide type wax such as ethylenediamine dibehenylamide and trimellitic acid tristearylamide.

The melting point of a wax usable in the invention is preferably 40 to 125° C., more preferably 50 to 120° C., and still more preferably 60 to 90° C. In the present invention, one of the waxes of the above-described waxes may be used singly or may be used in combination with other waxes. Among the above-described waxes, preferable waxes are microcrystalline wax and behenyl behanate, and the combination of these two waxes.

By using a wax having a melting point falling within the foregoing range, heat stability of toners can be ensured. And stable toner image formation can be achieved without causing cold offsetting even when the image is fixed at a relatively low temperature. The wax content of the toner is preferably in the range of 1% to 30% by mass, and more preferably 5% to 20%. By setting the added amount of the wax within the above-described range, undisturbed separation property of the paper in fixing step can be achieved, and further, the transparency of the toner image will not be decreased.

(Releasing Agents)

The toner of the present invention incorporates at least a binder resin, a colorant, and a releasing agent. One of the preferred embodiments of the toner of the present invention contains plural releasing agents composed of a first releasing agent and a second releasing agent. When two or more kinds of waxes are employed, the appearance of uneven wax formed in a solid image can be avoided. This unevenness of wax in a solid image will be caused by an interaction of coloring matters with the wax.

A first releasing agent component is composed of ester based waxes in an amount of commonly 40-98% by weight, but preferably 60-95% by weight, while a second releasing agent component is composed of branched hydrocarbon based waxes in an amount of commonly 60-2% by weight, but preferably 5-40% by weight.

By regulating the ratio of the first and second releasing agents to the aforesaid range, adhesion to an image carrier (also referred to as a transfer material or an image support) is assured, whereby even by low temperature fixing, it is possible to carry out fixing to result in sufficient fixing strength, and interlocked mutual interaction in a molecular state of the branched hydrocarbon waxes and the ester based waxes was sufficiently realized to enable retardation of transfer of all releasing agents onto the carrier.

It is possible to regard the content ratio of the first releasing agent component and the second releasing agent component as a ratio during the addition. When determination is carried out based on the toner, it is possible to calculate it based on the ratio of the tertiary carbon and the quaternary carbon via the branched hydrocarbon based waxes in all releasing agents, and the ratio of the branch of individual branched hydrocarbon based wax, previously determined.

(Ester Compounds)

As ester based wax, which is the first releasing agent component of the releasing agents constituting the toner of the present invention, employed may be any of the monoester compounds, the diester compounds, the triester compounds, and the tetraester compounds. For example, listed may be the esters of higher fatty acids and higher alcohols, represented by the following Formulas (1B)-(3B), the trimethylolpropane trimesters represented by the following Formula (4B), the glycerin trimesters represented by the following Formula (5B), and pentaerythritol tetraesters represented by the following Formula (6B).

$$R^1—COO—R^2 \quad \text{Formula (1B)}$$

$$R^1—COO—(CH_2)_n—OCO—R^2 \quad \text{Formula (2B)}$$

$$R^1—OCO—(CH_2)_n—COO—R^2 \quad \text{Formula (3B)}$$

In the above Formulas (1B)-(3B), $R^1$ and $R^2$ each represents a substituted or unsubstituted hydrocarbon group having commonly 13-30 carbon atoms, but preferably 17-22 carbon atoms, and $R^1$ and $R^2$ may be the same or different.

Formula (4B)

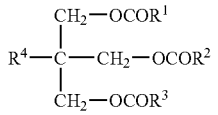

In the above Formulas (4B), $R^1$-$R^4$ each represents a substituted or unsubstituted hydrocarbon group having commonly 13-30 carbon atoms, but preferably 17-22 carbon atoms, and $R^1$-$R^4$ may be the same or different.

Formula (5B)

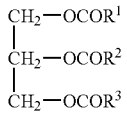

In the above Formula (5B), $R^1$-$R^3$ each represents a substituted or unsubstituted hydrocarbon group having commonly 13-30 carbon atoms, but preferably 17-22 carbon atoms, and $R^1$-$R^3$ may be the same or different.

Formula (6B)

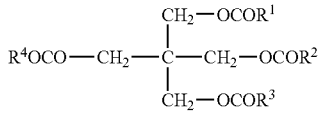

In the above Formula (6B), $R^1$-$R^4$ each represents a substituted or unsubstituted hydrocarbon group having commonly 13-30 carbon atoms, but preferably 17-22 carbon atoms, and $R^1$-$R^4$ may be the same or different.

As specific examples of the monoester compounds represented by the aforesaid Formula (1B), exemplified may be the compounds represented by Formulas (1B-1)-(1B-8).

$CH_3—(CH_2)_{12}—COO—(CH_2)_{13}—CH_3$ Formula (1B-1)

$CH_3—(CH_2)_{14}—COO—(CH_2)_{15}—CH_3$ Formula (1B-2)

$CH_3—(CH_2)_{16}—COO—(CH_2)_{17}—CH_3$ Formula (1B-3)

$CH_3—(CH_2)_{16}—COO—(CH_2)_{21}—CH_3$ Formula (1B-4)

$CH_3—(CH_2)_{20}—COO—(CH_2)_{17}—CH_3$ Formula (1B-5)

$CH_3—(CH_2)_{20}—COO—(CH_2)_{21}—CH_3$ Formula (1B-6)

$CH_3—(CH_2)_{25}—COO—(CH_2)_{25}—CH_3$ Formula (1B-7)

$CH_3—(CH_2)_{28}—COO—(CH_2)_{29}—CH_3$ Formula (1B-8)

As specific examples of the diester compounds represented by the aforesaid Formulas (2B) and (3B), exemplified may be the compounds represented by the following Formulas (2B-1) (2B-7), as well as the compounds represented by the following Formulas (3B-1)-(3B-3).

$CH_3—(CH_2)_{20}—COO—(CH_2)_4—OCO—(CH_2)_{20}—CH_3$ Formula (2B-1)

$CH_3—(CH_2)_{18}—COO—(CH_2)_4—OCO—(CH_2)_{18}—CH_3$ Formula (2B-2)

$CH_3—(CH_2)_{20}—COO—(CH_2)_2—OCO—(CH_2)_{20}—CH_3$ Formula (2B-3)

$CH_3—(CH_2)_{22}—COO—(CH_2)_2—OCO—(CH_2)_{22}—CH_3$ Formula (2B-4)

$CH_3—(CH_2)_{16}—COO—(CH_2)_4—OCO—(CH_2)_{16}—CH_3$ Formula (2B-5)

$CH_3—(CH_2)_{26}—COO—(CH_2)_2—OCO—(CH_2)_{26}—CH_3$ Formula (2B-6)

$CH_3—(CH_2)_{20}—COO—(CH_2)_6—OCO—(CH_2)_{20}—CH_3$ Formula (2B-7)

$CH_3—(CH_2)_{21}—OCO—(CH_2)_6—COO—(CH_2)_{21}—CH_3$ Formula (3B-1)

$CH_3—(CH_2)_{23}—OCO—(CH_2)_6—COO—(CH_2)_{23}—CH_3$ Formula (3B-2)

$CH_3—(CH_2)_{19}—OCO—(CH_2)_6—COO—(CH_2)_{19}—CH_3$ Formula (3B-3)

As specific examples of the triester compounds represented by the aforesaid Formula (4B), exemplified may be the compounds represented by the following Formulas (4B-1)-(4B-6).

Formula (4B-1)

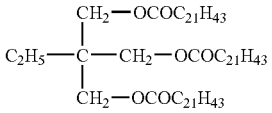

-continued

Formula (4B-2)

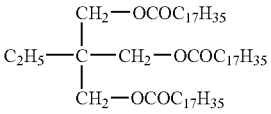

Formula (4B-3)

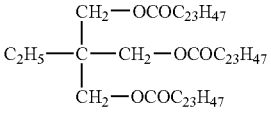

Formula (4B-4)

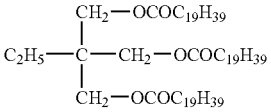

Formula (4B-5)

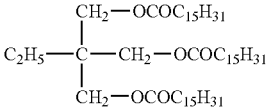

Formula (4B-6)

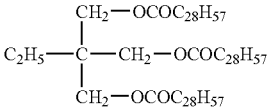

As specific examples of the triester compounds represented by the aforesaid Formulas (5B) constituting the first releasing agent component, exemplified may be the compounds represented by the following Formulas (5B-1)-(5B-6).

Formula (5B-1)

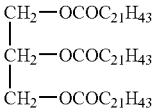

Formula (5B-2)

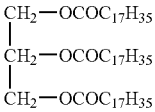

Formula (5B-3)

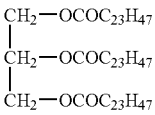

Formula (5B-4)

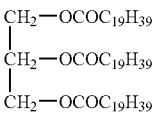

Formula (5B-5)

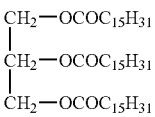

Formula (5B-6)

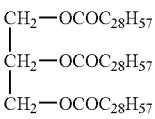

As specific examples of the tetraester compounds represented by the aforesaid Formula (6B), exemplified may be the compounds represented by the following Formulas (5B-1)-(6B-5).

Formula (6B-1)

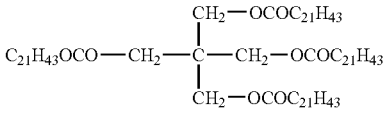

Formula (6B-2)

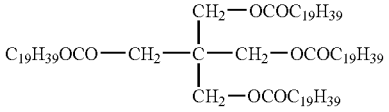

Formula (6B-3)

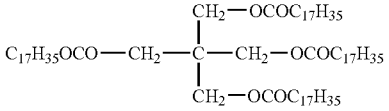

Formula (6B-4)

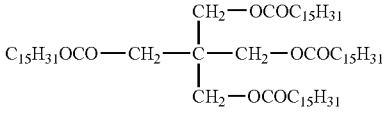

Formula (6B-5)

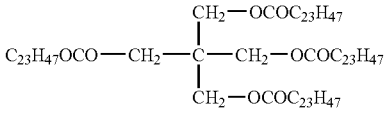

The ester based waxes which constitute the component of the first releasing agent may be structured in such a manner that a plurality of a monoester structure, a diester structure, a triester structure and a tetraester structure is incorporated in each molecule.

As the component of the first releasing agent which constitutes releasing agents, at least two types of the above ester compounds may also be employed in combination.

(Branched Hydrocarbon Based Waxes)

With regard to branched hydrocarbon based waxes which constitute the toner of the developer of the present invention, the branched ratio is preferably 0.1-20%, but is more preferably 0.3-1.0%. The branched ratio, namely the ratio of total tertiary and quaternary carbons to total carbons, which constitute the branched hydrocarbon based wax, refers to a value which is determined via the following method.

By regulating the ratio of total tertiary and quaternary carbon atoms to total carbon atoms constituting the branched hydrocarbon based wax to the range of 0.1-20%, even though the aforesaid branched hydrocarbon wax exhibits a low melting point, intermolecular interlocking is assured to enable minimal generation of transfer to the carrier of releasing agents.

In practice, it is possible to calculate the branched ratio in the branched hydrocarbon based waxes via the 13C-NMR measurement method under the following conditions based on following Formula (iB).

$$\text{Branched ratio (\%)}=(C3+C4)/(C1+C2+C3+C4)\times 100 \qquad \text{Formula (iB)}$$

In the above Formula (iB), C3 represents the peak area according to the tertiary carbon atom, and C4 represents the peak area according to the quaternary carbon atoms, while C1 represents the peak area according to the primary carbon atom, and C2 represents the peak area according to the secondary carbon atom.

(Conditions of 13C-NMR Measurement Method)

Measuring Equipment: FT NMR Equipment LAMBDA400 (produced by JEOL Ltd.)
Measurement frequency: 100.5 MHz
Pulse condition: 4.0 μs
Data point: 32,768
Delayed time: 1.8 second
Frequency range: 27,100 Hz
Integration repetition: 20,000 times
Measurement temperature: 80° C.
Solvents: benzene-$d^6$/o-dichlorobenzene-$d^4$=1/4 (v/v)
Sample concentration : 3% by weight
Sample tube: ϕ5 mm
Measurement mode: 1H perfect decoupling method Examples of branched hydrocarbon waxes include microcrystalline waxes such as HNP-0190, Hi-Mic-1045, Hi-Mic-1070, Hi-Mic-1080, Hi-Mic-1090, Hi-Mic-2045, Hi-Mic2065, or Hi-Mic-2095, as well as WAX EMW-0001 and EMW-0003 in which isoparaffin is a major component, all produced by Nippon Seiro Co., Ltd.

"Microcrystalline waxes", as described herein, refer to those which differ from paraffin waxes in which the major component is straight-chain hydrocarbon (normal paraffin) and in which the ratio of branched-chain hydrocarbon (isoparaffin) and ring hydrocarbon (cycloparaffin) is greater. Generally, since the microcrystalline waxes incorporate a large amount of low crystalline isoparaffin and cycloparaffin, crystals are smaller than paraffin waxes, while the molecular weight thereof is greater than paraffin waxes. The number of carbons, the weight average molecular weight, and the melting point of the aforesaid microcrystalline waxes is 25-60, 500-800, and 60-95° C., respectively.

As the microcrystalline waxes constituting the branched hydrocarbon waxes, preferred are those of a weight average molecular weight of 600-800, and a melting point of 60-95° C. Further preferred are those of a lower molecular weight, specifically more preferred are those of a number average molecular weight of 300-1,000, but further preferred are those of the same of 400-800. Further, it is preferable that the ratio Mw/Mn of the weight average molecular weight to the number average molecular weight is 1.01-1.20.

(Manufacturing Method of Branched Hydrocarbon Based Waxes)

As a manufacturing method of the branched hydrocarbon based waxes described above, listed are two methods, namely a press sweating method in which, while maintaining raw material oil at a specified temperature, solidified hydrocarbon is separated and collected, and a solvent extraction method in which solvents are added to reduced pressure distillation residual oil of petroleum or raw material oil which is heavy distillate oil to result in crystallization, followed by separation via filtration. However, the solvent extraction method is preferred. Further, since the branched hydrocarbon based waxes which are manufactured via the aforesaid methods are stained, purification may be carried out employing sulfuric acid clay.

As a second releasing agent component, it is also possible to employ combinations of at least two types of hydrocarbon compounds having the above branched-chain structure and/or ring structure.

The added amount of the total releasing agents in a toner is preferably 1-30% by weight, but is more preferably 5-20% by weight.

The melting point of the total releasing agents constituting a toner is, for example 60-100° C., is preferably 60-100° C., but is more preferably 65-85° C.

The melting point of a releasing agent is represented by the peak top temperature of its endothermic peak, and may be determined via, for example, a "DSC-7 differential calorimeter" (produced by PerkinElmer, Inc.) and "TSC7/DX thermal analyzer controller" (produced by PerkinElmer, Inc.).

In practice, approximately 4.00 g of a releasing agent was sampled and accurately weighed to at most two decimal places, followed by sealing in an aluminum pan (KIT NO. 0219-0041). The sealed sample was placed in a DSC-7 sample holder and was subjected to heat-cool-heat thermal control under conditions of a measurement temperature of 0-200° C., a temperature increasing rate of 10° C./minute, and a temperature decreasing rate of 10° C./minute. Subsequently, analysis was carried out based on data during the 2nd. Heat. An empty aluminum pan was employed for measurement of the reference.

When the melting point of total releasing agents is in the aforesaid range, the melting point of the individual branched hydrocarbon wax and the individual ester based wax is not particularly limited. However, the melting point of the individual ester based wax is, for example, 60-100° C., but is preferably 70-90° C., while the melting point of the individual branched hydrocarbon based wax is commonly 50-100° C., is preferably 60-100° C., but is more preferably 65-85° C.

Further, a well-known charge controlling agent can also be added to the toner of the present invention. A charge controlling agent is not particularly limited. A colorless, white, or light colored charge controlling agent which does not have an adverse effect on the color tone of a toner and on light transmittance can be used as a negative charge controlling agent. Examples of a negative charge controlling agent are as follows: a metal complex of a salicylic acid derivative; a calixarene compound; an organic boron compound; and a fluorine containing quaternary ammonium salt compound.

The above-mentioned salicylic acid metal complex which can be used in the present invention is disclosed, for example, in JP-A Nos. 53-127726 and 62-145255. As a calixarene compound which can be used is, for example, disclosed in JP-A No. 2-201378. As an organic boron compound which can be used is, for examples disclosed in JP-A Nos. 2-221967. As a fluorine containing quaternary ammonium salt compound which can be used is, for example, disclosed in 3-1162. The amount of addition of these charge controlling agent is preferably 0.1 to 10 mass parts to 100 mass parts of a binder resin, and more preferably 0.5 to 5.0 mass parts.

An image stabilizer can also be added in order to raise a image lasting quality. Examples of an image stabilizer include: the compounds disclosed in JP-A No. 8-29934; and an a phenol compound, an amine compound, a sulfur compound, a phosphor compound available in the market as an image stabilizer. In addition, an ultraviolet absorption agent can also be added for the same purpose, and a well-known organic ultraviolet absorption agent and an inorganic system ultraviolet absorption agent can be added.

Specific examples of an organic ultraviolet absorption agent are as follows, (1) Benzotriazole compound-2-(2'-hydroxy-5'-t-butylphenyl)benzotriazole, 2-(2'-hydroxy-3',5'-di-t-butylphenyl) benzotriazole;
(2) Benzophenone compound: 2-hydroxy-4-methoxybenzophenone and 2-hydroxy-4-n-octyloxybenzophenone;
(3) Phenyl salicylate compound: phenyl salicylate, 4-t-butylphenyl salicylate; and
(4) Hydroxybenzoate compound: 2,5-t-butyl-4-hydroxybenzoic acid n-hexadecyl ester, 2,4-di-t-butylphenyl-3',5'-di-t-butyl-4'-hydroxybenzoate.

Specific examples of an inorganic ultraviolet absorption agent are as follows: titanium oxide, zinc oxide, cerium oxide, iron oxide and barium sulfate. Among an organic ultraviolet absorption agent and an inorganic ultraviolet absorption agent, an organic system absorption agent is more preferable.

An ultraviolet absorption agent has preferably a 50% transmittance in the range of 350-420 nm, and more preferably in 360-400 nm. By making a 50% transmittance wavelength into the above-mentioned range, the shielding ability for an ultraviolet light can be exhibited and there is no influence of coloring by having added the ultraviolet absorption agent. Although the amount of addition of an ultraviolet absorption agent is not particularly limited, a preferably amount of addition is 10-200 mass % to coloring matter, and more preferably it is 50-150 mass %.

Furthermore, from a viewpoint of giving fluidity of a toner, or improving cleaning property, the toner of the present invention can be added and mixed a well-known external additive in the toner. The kinds of these external additives is not particularly limited, and various inorganic particulates, organic particulates, and lubricants can be used.

Examples of an inorganic particulates are: inorganic oxide particles such as silica, alumina, and titania; titanic acid compound particles such as strontium titanate, barium titanate and calcium titanate, a number average primary particle size of 5 to 300 nm of these particles are preferably 5-300 nm. These external additives may be subjected to a hydrophobic treatment using, for example, a silane coupling agent, a titanium coupling agent, a higher fatty acid, or silicone oil in order to improve environmental stability or heat-resistance during storage.

Spherical organic microparticles having a number-average primary particle size of 10 to 2000 nm are usable as organic microparticles. Specifically, there is usable styrene or methyl methacrylate homopolymer or their copolymers. Further, as a lubricant to be incorporated in the toner is aluminium stearate and zinc stearate.

Such an external additive may be added solely or in combination with two or more of other additives. Such an external additive is incorporated preferably in an amount of 0.05 to 5 weight % based on the total weight of the toner, and more preferably in an amount of 0.1 to 3 weight %.

(Manufacturing Method of Toner)

Methods to manufacture the toner of the present invention will be described. The methods are not particularly limited and listed may be a pulverization method, a suspension polymerization method, an mini-emulsion polymerization aggregation method, an emulsion polymerization aggregation method, a dissolution suspension method, and a polyester molecule elongation method, as well as other conventional methods. Of these, it is preferable to prepare the toner via the mini-emulsion polymerization aggregation method.

In a mini-emulsion polymerization aggregation method, a polymerizable monomer solution in which waxes are dissolved is placed into an aqueous medium in which surface active agents are dissolved to reach at most the critical micelle concentration, and by utilizing mechanical energy, a dispersion, in which 10-1,000 nm oil droplets are formed, is prepared. Water-soluble radical polymerization initiators are added to the resulting dispersion followed by polymerization, whereby binder resin particles are formed. Further, by aggregating binder resin particles while fusing particles, toner particles are prepared.

Reasons why the mini-emulsion polymerization aggregation method is preferred are that since polymerization is carried out within each oil droplet, it is possible to form a state in which wax particles are assuredly included via the binder resins within the toner particle, and as a result, vaporization components are not generated until heating via a fixing apparatus, and wax performance is not deteriorated, whereby targeted aims are assuredly achieved.

In addition, in the mini-emulsion polymerization aggregation method, instead of the addition of the aforesaid water-soluble radical polymerization initiators, or together with the water-soluble radical polymerization initiators, it is also possible to achieve polymerization by adding oil-soluble radical polymerization initiators into the aforesaid monomer solution.

As the toner preparation method, according to the present invention, during formation of resin particles via the mini-emulsion polymerization aggregation method, it is possible to form resin particles having a structure of at least two layers composed of binder resins which differ in composition. In this case, polymerization initiators and polymerizable monomers are added to the first resin particle dispersion which is prepared via a conventional mini-emulsion polymerization process (being a first step polymerization), and the resulting system then undergoes polymerization (being the second step polymerization). In the above manner, it is possible to form resin particles exhibiting a double layer structure. By repeating the above second step polymerization, it is possible to form resin particles, each having a multilayer structure.

One example of a method for producing a toner employing the mini-emulsion polymerization aggregation method will now be specifically described. The method includes the following procedures.

(1) a dissolving and dispersing process which prepares a polymerizable monomer solution by dissolving or dispersing, toner particle constituting materials such as a wax and a charge controlling agent according to need, in a polymerizable monomer used for a binding resin;
(2) a dispersed solution preparation process in which the aforesaid metal compound, dye and quinacridone pigment each are dispersed in an aqueous media to obtain: a metal compound particle dispersion solution, and a dye particle dispersion solution and a quinacridone pigment particle dispersion solution.
(3) a polymerization process in which oil droplets of the aforesaid polymerizable monomer solution are formed in an aqueous medium and then a binder resin particle dispersion is prepared using a mini-emulsion method;
(4) an aggregating and fusing process in which aggregated particles are formed from the aforesaid binder resin particles, dye particles and pigment particles via aggregation, and fusion in an aqueous medium;
(5) a ripening process in which a dispersion of the colored particles is prepared by ripening aggregated particle via thermal energy to regulate their shape;
(6) a cooling process in which the dispersion of colored particles are cooled;
(7) a filtering and washing process in which the aforesaid colored particles are subjected to solid-liquid separation from the cooled colored particle dispersion, and surface active agents and the like are removed from the aforesaid colored particles; and
(8) a drying process which dries the colored particles which have been washed.
(9) an external additive treatment process in which an external additive is added to the dried toner particles.

Each of the above processes will now be described below.

(1) Dissolving/Dispersion Process

This process is a process to dissolve or disperse toner particle constituting materials such as a wax and colorants in a polymerizable monomer to prepare a polymerizable monomer solution.

An amount of the wax is set so as to have the content of the wax in the toner to be in the afore-mentioned range.

An oil-soluble polymerization initiator and/or other oil-soluble components may be added to the polymerizable monomer solution.

(2) Dispersion Preparation Process

This dispersion preparation process is one in which the aforesaid metal compounds, the dyes and the quinacridone type pigments are dispersed into a respective aqueous medium, and each of the metal compound dispersion, the dye particle dispersion, and the colorant particle dispersion is prepared.

It is possible to prepare these colorant particle dispersions by dispersing colorants into an aqueous medium. The dispersion process of colorant particles is carried out in such a state that the concentration of surface active agents exceeds the critical micelle concentration (CMC) in water. Homogenizers employed for the dispersion process of colorant particles are not particularly limited and preferably employed are ultrasonic homogenizers, mechanical homogenizers, and pressure homogenizers such as a Manton-Gaulin homogenizer or pressure system homogenizer, as well as medium type homogenizers such as a sand grinder, a Getzmann mill, or a diamond fine mill.

It is possible to employ colorant particles which have undergone surface property modification. In practice, colorant particles are dispersed into solvents and surface property modifying agents are then added to the above dispersion. Subsequently, by increasing the temperature of the above system, the targeted reaction is carried out. After completion of the reaction, the colorant particles are collected via filtration. After repeated washing with the same solvents, drying is carried out, whereby it is possible to prepare minute colorant particles which have been treated with the surface property modifying agents.

(3) Polymerization Process

The above process is one to form binder resin particles incorporating waxes and binder resins. In the polymerization process, for example, the aforesaid polymerizable monomer solution is added to an aqueous medium incorporating surface active agents at a concentration of, at most, the critical micelle concentration, and oil droplets are formed via application of mechanical energy. Subsequently, by adding water-soluble radical polymerization initiators, a polymerization reaction is carried out in the aforesaid oil droplet. Further, when multilayer structure resin particles are formed, resin particles, which are employed as a nucleus particle in the aqueous medium, may be added.

The binder resin particles formed in the polymerization process may be or may be not colored. Colored binder resin particles are formed by polymerizing a monomer composition incorporating colorants. Further, when the binder resin particles, which are not colored, are formed, a colorant particle dispersion is added into the binder resin particle dispersion during the aggregation process, described below, followed by aggregation of the binder resin particles with the colorant particles, whereby it is possible to form toner particles.

"Aqueous medium", as described herein, refers to a medium which is composed of water as a major component (at least 50% by weight). Namely, it refers to a dispersion medium composed of 50-100% by weight of water and 0-50% by weight of water-soluble organic solvents.

Examples of water-soluble organic solvents, which are components other than water, include methanol, ethanol, isopropanol, butanol, acetone, methyl ethyl ketone, and tetrahydrofuran. Of these, specifically preferred are alcohol based organic solvents such as methanol, ethanol, isopropanol, and butanol, which do not dissolve the resins.

Further, methods to disperse a polymerizable monomer solution into an aqueous medium are not particularly limited, but a method is preferred in which dispersion is carried out via application of mechanical energy. Homogenizers in which oil droplet dispersion is carried out via application of mechanical energy are not particularly limited, but examples thereof include "CLEARMIX", ultrasonic homogenizers, mechanical homogenizers, Manton-Gaulin, and pressure system homogenizers. Further, the dispersed particle diameter of the polymerizable monomer solution is preferably 10-1,000 nm, but is more preferably 20-300 nm.

(4) Aggregation and Fusion Process

An aggregation and fusion process is one in which the binder resin particles, formed via the aforesaid polymerization process, are aggregated and fused in an aqueous medium. During the aggregation and fusion process, if the aforesaid binder resin particles are not colored, a colorant particle dispersion is added into the binder resin particle dispersion, followed by aggregation and fusion of the binder resin particles and the colorant particles. During the intermediate step of the above aggregation and fusion process, it is possible to carry out aggregation by the addition of binder resin particles which differ in the resin composition.

Further, in the aforesaid aggregation and fusion process, it is possible to carry out aggregation and fusion by the addition of internal additive particles such as charge control agents together with binder resin particles and colorant particles.

A preferred aggregation and fusion method is that aggregating agents composed of alkaline metal salts and alkaline earth metal salts are added, in an amount to reach at least the critical aggregation concentration, to an aqueous medium in which binder resin particles and colorant particles exist, whereby these particles are aggregated. Subsequently, heating is carried out to at least the glass transition temperature of the binder resin particles, as well as to at least the melt peak temperature of wax, whereby aggregation and fusion are simultaneously carried out.

During the above aggregation and fusion process, it is required to quickly increase the temperature by heating, and the temperature increasing rate is preferably at least 1° C./minute. The upper limit of the temperature increasing rate is not particularly limited. However, since coarse particles are generated via the progress of quick aggregation and fusion, to retard the above, at most 15° C./minute is preferred.

Further, it is critical that after the temperature of the binder resin particle and colorant particle dispersion reaches at most the glass transition and also at most the melt peak temperature of wax, coagulation and fusion are allowed to continue by maintaining the temperature of the aforesaid dispersion for a predetermined duration. As noted above, by maintaining the temperature of the dispersion for the predetermined duration, growth (coagulation of binder resin particles and colorant particles) of toner particles and fusion (elimination of the interface between the particles) are effectively carried out, whereby it is possible to enhance endurance of the finally prepared toner.

(5) Ripening Process

The above ripening process is one in which, in practice, a system incorporating aggregated particles is stirred while heated, and the shape of aggregated particles is regulated by controlling the heating temperature, the stirring rate, and the heating temperature to reach the targeted average circularity, whereby toner particles having the targeted shape are prepared. In the above ripening process, it is preferable to carry out shape control of toner particles via thermal energy (heating).

Further, during the aforesaid ripening process, a binder resin particle dispersion is further added to the aforesaid toner particle dispersion so that the binder resin particles are adhered onto the surface of the toner particle to result in fusion and toner particles designated, as a so-called core-shell structure, may be formed. In this case, it is preferable that the glass transition point temperature of the binder resin particles forming the shell is regulated to be 20° C. higher than that of the binder resin particles which constitute the core.

Further, when binder resin particles employed in the aforesaid aggregation and fusion process are composed of resins (hydrophilic resins) which are prepared by employing, as a raw material, polymerizable monomers having an ionic dissociation group, described below, and resins (hydrophobic resins) which are prepared by employing, as a raw material, only polymerizable monomers having no ionic dissociation group, it is possible to form toner particles having the core-shell structure in such a manner that during the above ripening process, the hydrophilic resins are oriented on the surface side of the aggregated particle, while hydrophobic resins are oriented on the interior side of the aggregated particle.

(6) Cooling Process

This process is a process of subjecting the dispersion of the toner particles to the cooling treatment. The condition of the cooling treatment is to cool is preferably at a cooling rate of 1-20° C./min. The method of the cooling treatment, although it is not specifically limited, may include a method of cooling by introducing a cooling medium from outside of a reaction container and a method of cooling by directly charging cool water into the reaction system.

(7) Solid-Liquid Separation and Cleaning Process

In the solid-liquid separation and cleaning process, the following treatments are applied: a solid-liquid separation treatment of subjecting the toner particles to solid-liquid separation from the dispersion of the toner particles having been cooled down to a predetermined temperature in the above process; and a cleaning treatment of removing deposits such as the surfactant and the salting-out agent from a toner cake (an aggregation substance with a cake-shape) having been subjected to solid-liquid separation.

In the cleaning treatment, the washing with water is repeated to and checked the electric conductivity of the filtrated water to become 10 μS/cm. In the solid-liquid separation treatment, the known methods such as the centrifugal separation method, vacuum filtration method using Nutsche, and the filter method using a filter press are employed.

(8) Drying Process

This process is a process of subjecting the toner cake having been subjected to the cleaning treatment to the dry treatment to obtain dried colored particles. Listed as the dryer used in this process may be, for example, a spray dryer, a vacuum-freeze dryer, and a decompression dryer, and it may be used a stationary rack-dryer, a movable rack-dryer, a fluidized dryer, a rolling dryer, an agitation dryer and other dryers. The water content of the dried colored particle is preferably 5% by weight or less, more preferably 2% by weight or less. Incidentally, when the toner particles having been subjected to the dry treatment are agglomerated with a weak intermolecular force among the particles, the agglomeration may be subjected to a powder treatment. Herein, mechanical type of powder machines such as a jet-mill, HENSCHEL MIXER, a coffee mill, a food processor may be used as the powder treatment machine.

(9) External Additive Treatment Process

This process is a process of manufacturing the toner by mixing an external additive in the dried toner particles according to the necessity. As the mixer for the external additive, mechanical type of mixers such as a HENSCHEL MIXER and a coffee mill may be used.

By following the above-described processes, the toner of the present invention can be produced with the mini-emulsion polymerization aggregation method.

Next, a surface active agent, a polymerization initiator, a chain transfer agent and an aggregation agent used in the preparation of the toner with the mini-emulsion polymerization aggregation method will be described.

(Surface Active Agents)

When the toner according to the present invention is produced via a suspension polymerization method, the aforesaid mini-emulsion polymerization aggregation method, or an emulsion polymerization aggregation method, surface active agents are added into an aqueous medium whereby binder resins and aggregated particles are prepared. Surface active agents employed in these polymerization methods are not particularly limited, but the ionic surface active agents listed below are preferred:

(1) sulfonic acid salts; sodium dodecylbenznesulfonate and sodium arylalkylpolyether sulfonate
(2) sulfuric acid ester salts; sodium dodecylsulfate, sodium tetradecylsulfate, sodium pentadecylsulfate, and sodium octylsulfate
(3) fatty acid salts; sodium oleate, sodium laurate, sodium caprate, sodium caprylate, sodium caproate, potassium stearate, and calcium oleate.

Further, it is also possible to employ the nonionic surface active agents listed below: namely, polyethylene oxides, polypropylene oxides, combinations of polypropylene oxides and polyethylene oxides, esters of polyethylene glycol with higher fatty acids, alkylphenol polyethylene oxides, esters of higher fatty acid and polyethylene glycol, esters of higher fatty acid and polypropylene oxides, and sorbitan esters.

(Polymerization Initiators)

When the toner according to the present invention is produced via a suspension polymerization method, the aforesaid mini-emulsion polymerization aggregation method, or an emulsion aggregation method, it is possible to form binder resins by polymerizing polymerizable monomers while employing radical polymerization initiators.

When resins are formed via the suspension polymerization method, oil-soluble radical polymerization initiators are employable. Specific examples of the oil-soluble polymerization initiators include:

(1) azo based or diazo based polymerization initiators; 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile
(2) peroxide based polymerization initiators; benzoyl peroxide, methyl ethyl ketone peroxide, diisopropylperoxycarbonate, cumenehydroperoxide, t-butylhydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine, and
(3) polymer polymerization initiators having a peroxide on the side chain Further, when binder resins are formed via the mini-emulsion polymerization aggregation method or the emulsion polymerization aggregation method, water-soluble radical polymerization initiators are employable. Examples of water-soluble radical polymerization initiators include persulfate salts such as potassium persulfate or ammonium persulfate, azobisaminodipropane acetic acid salts, azobiscyanovaleric acid and salts thereof, and hydrogen peroxide.

(Chain Transfer Agents)

When the toner according to the present invention is produced via a suspension polymerization method, the aforesaid mini-emulsion polymerization aggregation method, or an emulsion polymerization aggregation method, to regulate the molecular weight of binder resins, prior art chain transfer agents are employable. Specific chain transfer agents include mercaptans such as n-octylmercaptan, n-decylmercaptan, or tert-dodecylmercaptan, as well as n-octyl-3-mercaptopropionic acid esters, terpinolene, carbon tetrabromide, and α-methylstyrene dimers.

(Aggregating Agents)

When the toner according to the present invention is produced via a mini-emulsion polymerization aggregation method or an emulsion polymerization aggregation method, in order to aggregate resin particles, aggregating agents are employed. Examples of aggregating agents include alkaline metals and alkaline earth metals. Alkaline metals to constitute aggregating agents include lithium, potassium, and sodium, while alkaline earth metals to constitute aggregating agents include magnesium, calcium, strontium, and barium. Of these, preferred are potassium, sodium, magnesium, calcium, and barium. As a counter ion (being an anion to constitute a salt) of the aforesaid alkaline metals or alkaline earth metals, listed are a chloride ion, a bromide ion, an iodide ion, a carbonate ion, and a sulfate ion.

When the toner according to the present invention is employed as a developer, in a single component based developer which employs only the toner according to the present invention, or even in a double component based developer composed of a toner and a carrier, either one enables realization of favorable image formation which exhibits the targeted effects of the present invention. In addition, when employed as a single component based developer, it is possible to employ it as a magnetic single component developer incorporating magnetic metal particles in the toner particles or as a non-magnetic single component developer incorporating no magnetic metal particles in the toner particles.

Carriers, which are employed in the case employed as a double component developer, are not particularly limited, and any prior art carriers are employable. Specifically, preferred are the resin coated carriers which are described in JP-A Nos. 62-39879 and 56-11461.

Resin coated carriers will now be described. The volume based median diameter of carriers is preferably 20-80 μm, but in view of realizing preferred image quality and enhancing filming resistance, is more preferably 25-35 μm. Further, in nucleus particles which constitute the resin coated carrier, it is possible to employ ferrite and magnetite granulation materials, and of these, preferred are ferrites. In view of minimizing carrier adhesion, of those known in the art, as a ferrite composition, preferred are manganese-magnesium-strontium ferrites.

As coating resins which constitute the resin coated carrier, employed are polymer resins in which the polymerizable monomers listed below are individually employed or copolymer resins which are formed by employing at least two types of the polymerizable monomers listed below:

(1) styrenes; styrene and a-methylstyrene
(2) α-methylene fatty acid monocarboxylic acids; methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate, (3) nitrogen-containing acryls; dimethylaminoethyl methacrylate (4) vinylpyridines; 2-vinylpyridine and 4-vinylpyridine (5) vinyl nitriles; acrylonitrile and methacrylonitrile (6) vinyl ethers; vinyl methyl ether and vinyl isobutyl ether (7) vinyl ketones; vinyl methyl ketone, vinyl ethyl ketone, and vinyl isopropenyl ketone (8) olefins; ethylene and propylene (9) vinyl based fluorine-containing monomers; vinylidene fluoride, tetrafluoroethylene, and hexafluoroethylene Further, the following resins are applicable; namely silicone resins incorporating methylsilicone or methylphenylsilicone, polyester resins incorporating bisphenol or glycol, epoxy resins, polyurethane resins, polyamide resins, cellulose resins, polyether resins, and polycarbonate resins.

It is possible to form coating resins by employing these resins individually or in combinations of at least two types. Of these, in view of humidity dependence during charging, preferred are styrene/cyclohexyl methacrylate copolymer resins (at a copolymerization ratio of 5:5-9:1). From the same point of view, preferred are those in which approximately 50% of perfluoroacrylate is simultaneously employed.

Further, in view of abrasion resistance of resin coating layers, it is possible to add methyl polymethacrylate resin or melamine resin particles at a number average particle diameter of 0.1-0.3 μm. In addition, in view of enhancing development characteristics, it is possible to add carbon black, graphite, titanium oxide, and aluminum oxide to the resin coating layer in an amount of about 5-about 30%.

The coated amount of coating resins is preferably in the range of 0.1-10 parts by weight with respect to 100 parts by weight of nucleus particles, but is more preferably in the range of 0.5-3.0 parts by weight.

Further, it is possible to select an appropriate mixing ratio of a toner and a carrier which constitute a double component developer, depending on the specified target.

An Image forming method, which is carried out employing the toner according to the present invention, will now be described. The electrophotographic system image forming method, which is carried out employing the toner according to the present invention, includes at least the following processes: namely (1) an electrostatic latent image forming process which forms electrostatic latent images on an electrostatic latent image carrier (being a photoreceptor), (2) a development process which forms toner images by developing electrostatic latent images formed on the electrostatic latent image carrier by employing a developer which is prepared by incorporating the toner according to the present invention, (3) a transfer process which transfers toner images formed on the electrostatic latent image carrier onto a transfer body such as a sheet, and (4) a fixing process which fixes the toner images transferred onto the transfer body.

In addition to the aforesaid four processes, other processes may be included. For example, after transferring toner images, it is preferable to include a cleaning process which removes any residual toner on the surface of the electrostatic latent image carrier. Further, during the transfer process, the toner image transfer onto a recording medium, from the electrostatic latent image carrier, may be carried out via an intermediate transfer body.

The image forming method employing the toner of the present invention enables so-called low temperature fixing, whereby it is possible to prepare toner images of highly lustrous image quality. Further, it is possible to maintain excellent developability, transferability, fluidity, and storage properties over an extended period. Further, by realizing low temperature fixing, it is possible to further more reduce energy consumption during image formation.

FIG. 1 illustrates an example of an image forming apparatus in which the toner of the present invention is usable as a two-component developer.

In FIG. 1, 1Y, 1M, 1C and 1K each designate photoreceptors; 4Y, 4M, 4C and 4K each designate a developing means; 5Y, 5M, 5C and 5K each designate primary transfer rollers; 5A designates a secondary transfer roller; 6Y, 6M, 6C and 6K each designate cleaning means; the numeral 7 designates an intermediate transfer unit; the numeral 24 designates a thermal roll type fixing device; and the numeral 70 designates an intermediate transfer material.

This image forming apparatus is called a tandem color image forming apparatus, which is, as a main constitution, composed of plural image forming sections 10Y, 10M, 10C and 10B, an intermediate transfer material unit 7 including an endless belt form of a transfer belt, paper feeding and conveying means 22A to 22D to convey recording member P and heated roll-type fixing device 24. Original image reading device SC is disposed in the upper section of image forming apparatus body A.

Image forming section 10Y to form a yellow image contains a drum-form photoreceptor 1Y; electrostatic-charging means 2Y, exposure means 3Y and developing means 4Y which are disposed around the photoreceptor 1Y; primary transfer roller 5Y; and cleaning means 6Y.

Image forming section 10M to form a magenta image as another color contains a drum-form photoreceptor 1M; electrostatic-charging means 2M, exposure means 3M and developing means 4M which are disposed around the photoreceptor 1M; primary transfer roller 5M; and cleaning means 6M.

Image forming section 10C to form a cyan image as another color contains a drum-form photoreceptor 1C; electrostatic-charging means 2Y, exposure means 3C and developing means 4C which are disposed around the photoreceptor 1C; primary transfer roller 5C; and cleaning means 6C.

Further, there are provided an image forming section 10K to form a black image containing a drum-form photoreceptor 1K; electrostatic-charging means 2K, exposure means 3K and developing means 4K which are disposed around the photoreceptor 1K; primary transfer roller 5K; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray 26 outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Secondary transfer roller 5A is compressed onto intermediate transfer material 70 only when recording member P passes through to perform secondary transfer.

In the process of image formation, toner images are formed on photoreceptors 1Y, 1M, 1C and 1K, through electrostatic-charging, exposure and development, toner images of the individual colors are superimposed on the endless belt form, intermediate transfer material 70, transferred together onto recording member P and fixed by compression and heating in heat-roll type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

Moreover, a full-color image formation method using a non-magnetic mono-component developer can be realized by using, for example, an image forming apparatus in which the afore-mentioned development means for a two-component developer is substituted with a well-known development means for a non-magnetic mono-component developer.

Further, the fixing method that can be used for an image formation method using the toner of the present invention is not particularly limited, and a well-known fixing system can be applied. Examples of a well-known fixing system are: a roller fixing system containing a heat roller and a pressure roller; a fixing system containing a heat roller and a pressure belt: a fixing system containing a heat belt and a pressure roller; a belt fixing system composed of the heat belt and a press belt. Any of these systems may be used. Moreover, as a heating system, well-known heating systems can be used such as a halogen lamp system, and IH fixing system.

Figure 2:
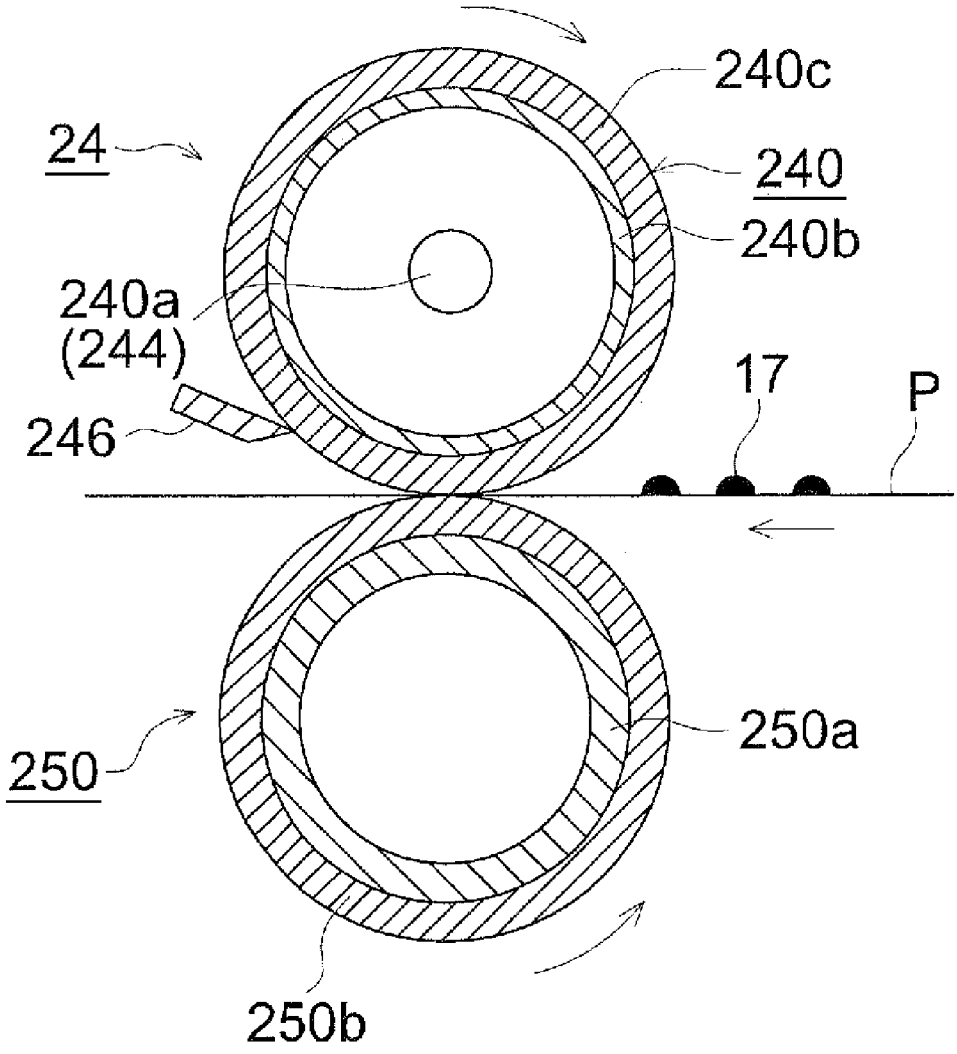
FIG. 2 is a schematic view showing an example of a fixing apparatus using a heat roller.

As specific examples of a fixing device: a fixing device using a heat roller; and a fixing device using a heat roller and a pressure belt, will be described. FIG. 2 is a schematic view showing an example of a fixing apparatus using a heat roller.

The fixing device 24 shown in FIG. 2 contains a heat roller 240 and a pressure roller 250 abutting the heat roller 240. Incidentally, in FIG. 2, reference numeral 246 denotes a separation nail and P is a paper on which a toner image is formed (transfer sheet).

The heat roller 240 contains a coating layer 240*c* made of a fluorocarbon resin or an elastic body formed on a surface of a cored bar 240*a*, the heat roller 240 further containing a heat member 244 made of a linear heater.

The cored bar 240*a* is composed of a metal and the inner diameter thereof is preferably 10-70 mm. The metal composing the cored bar 240*a* is not specifically limited, and such metals may be listed including, for example, iron, aluminum, copper or alloys of these metals.

The wall thickness of the cored bar 240*a* is preferably 0.1-15 mm, which is determined considering the balance between the requirement of energy saving (making the wall thinner) and the strength (depending on the component materials). For example, in order to keep the strength equivalent to that of the cored bar made of 0.57 mm thickness iron by the cored bar made of aluminum, the thickness of 0.8 mm is required.

As the fluorocarbon resin composing a surface of the coating layer 240*c*, for example, PTFE (polytetrafluoroethylene) and PFA (tetrafluoroetylene-perfluoroalkylvinylether copolymer) may be listed.

The thickness of the coating layer 240*c* made of fluorocarbon resin is preferably 10-500 μm, and more preferably 20-400 μm.

When the thickness of the coating layer 240*c* containing fluorocarbon resin is less than 10 μm, the function as the coating layer cannot be adequately performed, so that the durability as the fixing device cannot be assured. On the other hand, the surface of the coating layer over 500 μm tends to have bruises due to paper powders, and the toner or other materials adheres at the bruise portions, causing the problem of image staining.

Further, as the elastic body composing the coating layer 240*c*, a silicon rubber and a silicon sponge rubber having high heat resistance, for example, LTV, RTV and HTV are preferably used.

An Asker C hardness of the elastic body composing the coating layer 240*c* is preferably less than 80°, and more preferably less than 60°.

Further, the thickness of the coating layer 240*c* made of the elastic body is preferably 0.1-30 mm, and more preferably 0.1-20 mm.

As the heat member 244, a halogen heater is preferably used.

The pressure roller 250 contains a coating layer 250*b* made of an elastic body formed on a surface of a cored bar 250*a*. The elastic body composing the coating layer 250*b* is not specifically limited, and various types of soft rubbers and sponge rubbers, for example, polyurethane rubber and silicon rubber are usable. Silicon rubber or silicon sponge rubber are preferably used as a material used for the coating layer 250*b*.

Further, the thickness of the coating layer 250*b* is preferably 0.1-30 mm, and more preferably 0.1-20 mm.

Further, the fixing temperature (the surface temperature of the heat roller 10) is preferably 70-210° C., and the fixing linear velocity is preferably 80-640 mm/sec. The nip width of the heat roller is preferably 8-40 mm, and more preferably 11-30 mm.

Separation nail 246 is provided in order to prevent the transfer paper subjected to thermal fixing treatment with heat roller 240 from winding on heat roller 240.

Moreover, when the toner of the present invention is employed, it is desirable to use the fixing device which can supply efficiently the heat supplied from a heating member to a paper. It is desirable to specifically use the fixing device containing so called belt fixing method in which a heat-resistant belt is used for either a heating member or a pressure providing member.

Figure 3:
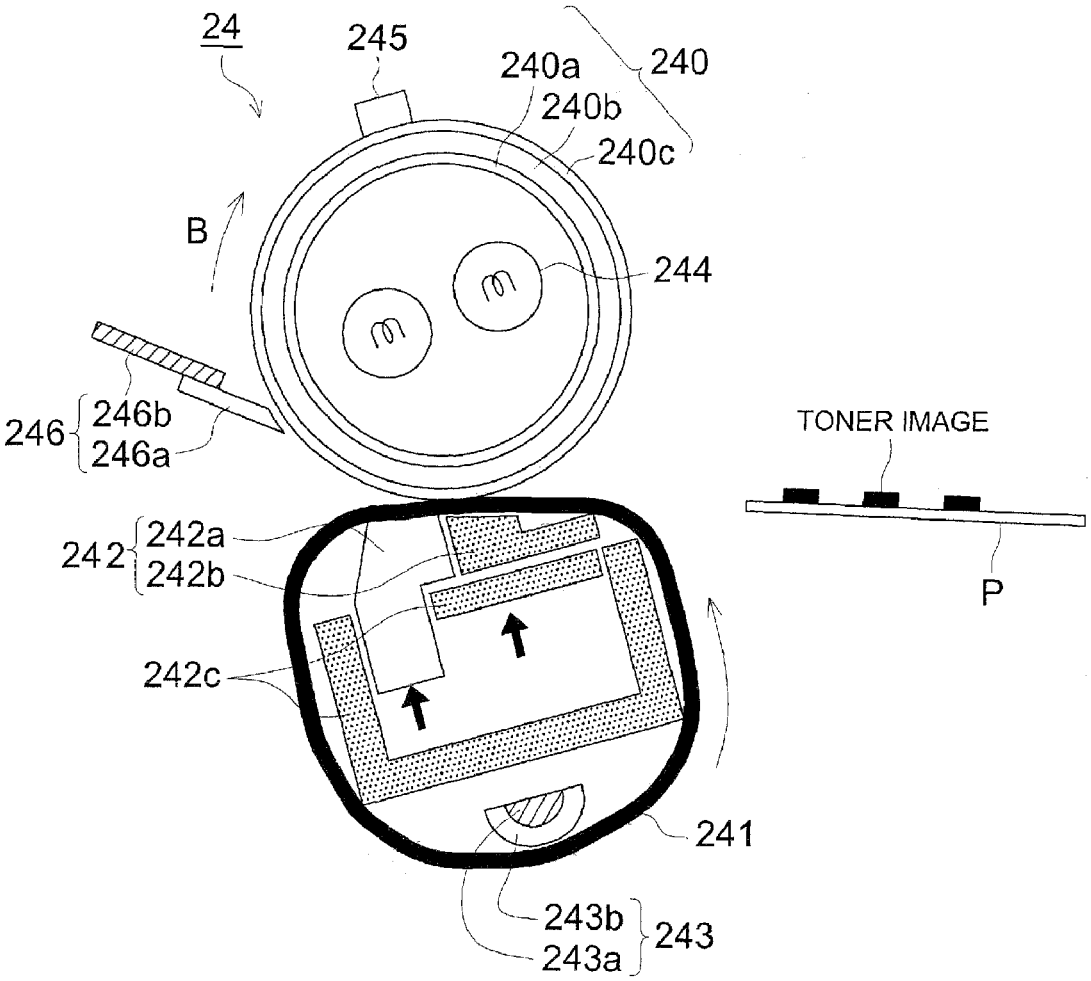
FIG. 3 is a schematic view showing an example of a fixing apparatus using a belt fixing method.

FIG. 3 is a schematic view showing an example of the fixing device (a type using a belt and a heat roller).

The fixing device 24 shown in FIG. 3 is a type using a belt and the heat roller for keeping the nip width, wherein the key section contains a heat roller 240 and a seamless belt 241, a pressure pads (pressure members) 242*a*, 242*b* which are pressed against the heat roller 240 via the seamless belt 241, and a lubricant supplying member 243. B represents the rotation direction of the heat roller 240.

The heat roller 240 contains a heat resistant elastic body layer 240*b* and a releasing layer (heat resistant resin layer) 240*c* which are formed around a metal core (cylindrical cored bar) 240*a*, wherein inside the core 240*a* is provided with the halogen lamp 244 as the heat source. The temperature of a surface of the heat roller 240 is measured with the temperature sensor 245, and the halogen lamp is feedback-controlled by a temperature controller not shown in response to the measured signal, whereby the surface of the heat roller 240 is controlled so that the temperature thereof is constant. The seamless belt 241 is contacted as to be wound by a predetermined angle relative to the heat roller 240 to form a nip section.

Inside the seamless belt 241 is provided with a pressure pad 242 having a low friction layer on a surface thereof in the state of being pressed against the heat roller 240 via the seamless belt 241. The pressure pad 242 contains the pressure pad 242*a* to which a strong nip pressure is applied and the pressure pad 242*b* to which a weak nip pressure is applied, the pressure pads 242*a*, 242*b* being held by a holder 242*c* made of metal or other materials.

The holder 242*c* is further mounted with a belt-travel guide so that the seamless belt 241 can slide and rotate smoothly. Because the belt-travel guide chafes against an inner surface of the seamless belt 241, a member for the belt-travel guide is desired to have a lower friction coefficient and also has a low heat conduction in order not to take the heat away from the seamless belt 241. As a specific example of the material of the seamless belt 241, polyimide is preferably used.

EXAMPLES

The present invention will now be specifically described with reference to examples, however the present invention is not limited to the following description. "Parts" in the following description refers to "parts by weight".

1. Toner Preparation via Pulverization Method (Preparation of "Magenta Toner 1")

<Process A>

| | |
|---|---|
| Polyester resin (condensation product, at a weight average molecular weight of 20,000, of bisphenol A ethylene oxide addition product with terephthalic acid and trimellitic acid) | 100 parts by weight |
| Dye (DX-2) | 3 parts by weight |
| Quinacridone Pigment (2-1) (master batch at a concentration of 50%) | 7 parts by weight |
| Pentaerythritol tetrastearate (wax) | 6 parts by weight |
| Dibenzilic acid boron (charge control agent) | 1 part by weight |

The foresaid compounds were placed in a Henschel mixer (produced by Mitsui Miike Mining Co., Ltd.), and underwent a blending treatment at a peripheral rate of the stirring blade of 25 m/second over 5 minutes. During the above operation, the blending treatment was carried out by feeding chilled water at 9° C. into the jacket of the Henschel mixer, and the treatment was carried out while the temperature of the mixture was maintained at 25° C.

<Process B>

Subsequently, 3.4 parts by weight of Metal Compound (1-2) were placed in the above "Henschel mixer", and underwent a blending treatment at a peripheral rate of the stirring blade of 40 m/second over 30 minutes. During the above operation, a blending treatment was carried out while heated water at 40° C. was fed into the jacket of the Henschel mixer, and the treatment was carried out while the temperature of the mixture was maintained at 47° C.

<Process C>

The resulting mixture underwent a kneading treatment employing a biaxial extrusion kneader while heated at 140° C. The temperature of the kneaded product was 145° C. at the discharge section of the aforesaid kneader. After the kneading treatment, the resulting kneaded product was allowed to stand to cool for 6 hours.

<Pulverization and Classification Process>

When the temperature of the kneaded product reached 28° C., it was coarsely pulverized via a hammer mill, followed by pulverization via a "TURBOMILL PULVERIZER (produced by Turbo Kogyo Co., Ltd.)". Further, fine powder classification treatment was carried out employing an air flow classifier utilizing the Coanda effect, whereby toner particles of a volume based median diameter of 5.4 μm were produced.

<External Additive Treatment Process>

The external additives described below were added to the prepared toner particles. Namely:

| | |
|---|---|
| Silica (average primary particle diameter of 12 nm, treated with hexamethylsilazane) | 0.6 part by weight |
| Titanium dioxide (average primary particle diameter of 24 nm, treated with n-octylsilane) | 0.8 part by weight |

The above compounds were blended under conditions of a stirring blade peripheral rate of 35 m/second, a processing temperature of 35° C., and a processing period of 15 minutes, employing a Henschel mixer (produced by Mitsui Miike Mining Co., Ltd.). Based on the above steps, "Magenta Toner 1" of a volume based median diameter of 5.4 μm was prepared. It was noted that the shape and particle diameter of the above toner particles resulted in no change by the addition of external additives.

(Preparation of "Magenta Toners 2 and 3") "Magenta Toner 2" of a volume based median diameter of 5.5 μm was prepared in the same manner as the above "Magenta Toner 1", except that no Quinacridone Pigment (2-1) was added. Further, "Magenta Toner 3" of a volume based median diameter of 5.5 μm was prepared in the same manner as the above "Magenta Toner 1", except that neither Dye (DX-2) nor Metal Compound (1-2) was added.

2. Toner Preparation via Mini-Emulsion Polymerization Aggregation Method (Preparation of "Magenta Toner 4")

2-1. Preparation of Various Dispersions (1) Preparation of Dye Particle Dispersion While stirring, 7.0 parts by weight of sodium n-dodecyl sulfate were placed in 160 parts by weight of ion-exchanged water followed by dissolution, whereby an aqueous surface active solution was prepared. Subsequently, 20 parts by weight of Dye (DX-1) were gradually added to the resulting aqueous surface active agent solution, followed by dispersion employing "CLEARMIX W MOTION CLM-0.8 (produced by M Technique Co.), whereby "Dye Particle Dispersion 1" was produced.

The volume based median diameter of dye particles of "Dye Particle Dispersion 1" was determined, resulting in 292 nm. The volume based median diameter of dye particles were calculated under the following conditions, employing "MICROTRAC UPA-150 (produced by Honeywell Co.).

Determination conditions included:

Sample refractive index: 1.59

Sample specific gravity: 1.05 (in terms of spherical particle)

Solvent refractive index: 1.33

Solvent viscosity: 0.797 (at 30° C.) and 1.002 (at 20° C.)

Zero point adjustment: adjustment was carried out by placing ion-exchanged water in a measurement cell).

(2) Preparation of Metal Compound Particle Dispersion

"Metal Compound Particle Dispersion 1" was prepared using the same steps as the preparation of the above "Dye Particle Dispersion 1", except that Dye (DX-1) was replaced with 20 parts by weight of Metal Compound (1-20). The volume based median diameter of metal compound particles of "Metal Compound Particle Dispersion 1" was 320 nm.

(3) Preparation of Quinacridone Pigment Dispersion

"Quinacridone Pigment Dispersion 1" was prepared in the same manner as the above "Dye Particle Dispersion 1", except that Dye (DX-1) was replaced with 8 parts by weight of Quinacridone Pigment (2-1). The volume based median diameter of the quinacridone pigment of "Quinacridone Pigment Dispersion 1" was 222 nm.

2-2. Preparation of Toner Particles (1) Preparation of "Toner Particles 1"

(a) First Step Polymerization

In a reaction vessel fitted with a stirrer, a temperature sensor, a cooling pipe, and a nitrogen introducing unit, an aqueous surface active agent solution was prepared by dissolving 4 parts by weight of the anionic surface active agent (sodium dodecylsulfate) having the following structural formula in 3,040 parts by weight of ion-exchanged water.

Anionic surface active agent; $C_{10}H_{21}(OCH_2CH_2)SO_3Na$

A polymerization initiator solution prepared by dissolving 10 parts by weight of potassium persulfate (KPS) in 40 parts by weight of ion-exchanged water was added to the aforesaid surface active agent solution. After increasing the liquid temperature to 75° C., a polymerizable monomer solution composed of the compounds described below was dripped over one hour.

| | |
|---|---|
| Styrene | 532 parts by weight |
| n-Butyl acrylate | 200 parts by weight |
| Methacrylic acid | 68 parts by weight |
| n-Octylmercaptan | 16.4 parts by weight |

After dripping the aforesaid polymerizable monomer solution, polymerization reaction (first step polymerization) underwent while stirred and heated at 75° C. for two hours, whereby "Resin Particle Dispersion (1H)" incorporating "Resin Particles (1h)" was prepared. The weight average molecular weight of formed "Resin Particles (1h)" was 16,500.

(b) Second Step Polymerization

| | |
|---|---|
| Styrene | 101.1 parts by weight |
| n-Butyl acrylate | 62.2 parts by weight |
| Methacrylic acid | 12.3 parts by weight |
| n-Octylmercaptan | 1.75 parts by weight |

The aforesaid compounds were placed in a flask fitted with a stirrer, and a polymerizable monomer solution was prepared. Thereafter, the following wax was added:

| | |
|---|---|
| Paraffin wax "HNP-57 (produced by Nippon Seiro Co., Ltd) | 93.8 parts by weight. |

By heating the interior to 90° C., the aforesaid wax was dissolved, whereby a monomer solution incorporating the paraffin wax was prepared.

Separately, an aqueous surface active agent solution was prepared by dissolving 3 parts by weight of the anionic surface active agent employed in the aforesaid first step polymerization at 1,560 parts by weight of ion-exchanged water, and was heated so that the internal temperature reached 98° C. Subsequently, added to the above surface active agent solution were 32.8 parts by weight (in terms of solids) of the aforesaid "Resin Particles (1h)" and further, the monomer solution incorporating the aforesaid paraffin wax. Thereafter, by employing a mechanical homogenizer "CLEARMIX, produced by M Technique Co., a mixing and dispersing treatment was carried out over 8 hours, whereby an oil droplet dispersion incorporating oil droplets at a dispersed particle diameter of 340 nm was prepared.

Subsequently, to the aforesaid oil droplet dispersion, added was a polymerization initiator solution prepared by dissolving 6 parts by weight of potassium persulfate to 200 parts by weight of ion-exchanged water. The resulting mixture was heated at 98° C. for 12 hours while stirred, whereby a polymerization reaction (a second step polymerization) underwent. Via the aforesaid polymerization reaction, "Resin Particle Dispersion (1HM)" incorporating "Resin Pericles (1hm)" was prepared. The weight average molecular weight of formed "Resin Particles (1hm)" was 23,000.

(c) Third Step Polymerization

A polymerization initiator solution prepared by dissolving 5.45 parts by weight of potassium persulfate in 220 parts by weight of ion-exchanged water was added to "Resin Particle Dispersion (1HM)" formed via the aforesaid second step polymerization, and a polymerizable monomer solution, composed of the compounds described below, was dripped over one hour under the temperature condition of 80° C.

| | |
|---|---|
| Styrene | 293.8 parts by weight |
| n-Butyl acrylate | 154.1 parts by weight |
| n-Octylmercaptan | 7.08 parts by weight |

After dripping the aforesaid polymerizable monomer solution, a polymerization reaction (a third step polymerization) underwent by heating and stirring over two hours. Thereafter, the temperature was lowered to 28° C., whereby "Resin Particle Dispersion 1" incorporating "Resin Particles 1" was prepared. The weight average molecular weight of formed "Resin Particles 1" was 26,800.

(2) Preparation of "Toner Particles 4"

(a) Aggregation and Fusion Process

Into a reaction vessel fitted with a stirrer, a temperature sensor, a cooling pipe, and a nitrogen introducing unit, placed were:

| | | |
|---|---|---|
| Resin Particles 1 | 420.7 | parts by weight (in terms of solids) |
| Ion-exchanged water | 500 | parts by weight |
| Dye Particle Dispersion 1 | 3.2 | parts by weight (in terms of solids) |
| Quinacridone pigment dispersion 1 | 3.5 | parts by weight (in terms of solids) |
| Metal Compound Particle Dispersion 1 | 4.5 | parts by weight (in terms of solids) |

and after regulating the interior to 30° C. while stirring, the pH was regulated to 10 by the addition of a 5 mol/liter aqueous potassium hydroxide solution.

Subsequently, an aqueous solution, prepared by dissolving 2 parts by weight of magnesium chloride hexahydrate in 1,000 parts by weight of water, was added at 30° C. while stirred over 10 minutes. After the addition, the resulting mixture was allowed to stand for three minutes, followed by further heating. The temperature of the above system was increased to 75° C. over 60 minutes, and the aforesaid particles were aggregated. Subsequently, the average diameter of aggregated particles was determined via "COULTER MULTISIZER 3 (produced by Beckmann Coulter Co.), and when the volume based median diameter reached 6.5 μm, an aqueous solution prepared by dissolving 8.2 parts by weight of sodium chloride in 50 parts by weight of ion exchanged water was added, and particle growth was terminated.

Further, the liquid temperature was regulated to 80° C., and fusion was allowed to continue via heating and stirring over 4 hours, whereby "Toner Particle Dispersion 1" was prepared. With regard to "Toner Particle Dispersion 1", the average circularity of toner particles was determined employing "FPIA2100 (produced by Sysmex Corp.), resulting in 0.940.

(b) Washing and Drying Process

Subsequently, prepared "Toner Particle Dispersion 1" was filtered and washed several times with ion-exchanged water at 45° C. After the washing process, drying was carried out via an air flow of 40° C., whereby "Toner Particles 4" at a volume based median diameter of 6.2 μm was prepared.

(3) External Addition Process

To prepared "Toner Particles 4" were added the following external additives:

| | |
|---|---|
| hexamethylsilazane-treated silica (at an average primary particle diameter of 12 nm) | 0.6 part by weight |
| and | |
| n-octylsilane-treated titanium dioxide (at an average primary particle diameter Of 24 nm) | 0.8 part by weight. |

External addition processes were carried out in such a manner that by employing a Henschel mixer (produced by Mitsui Miike Mining Co., Ltd.), mixing was performed under conditions of a stirring blade peripheral rate of 35 m/second, a processing temperature of 35° C., and a processing period of 15 minutes. As described previously, "Magenta Toner 4" was prepared. It was noted that prepared "Magenta Toner 4" resulted in no change of the shape and the particle diameter prior to and after the aforesaid external addition processes.

(Preparation of "Magenta Toners 5-19")

Each of "Magenta Toners 5-19" was prepared in the same manner as the aforesaid "Magenta Toner 4", except that dyes, metal compounds, and quinacridone pigments were changed as listed in Table 1.

(Preparation of "Magenta Toners 20 and 21")

Comparative "Magenta Toner 20" was prepared in the same manner as the aforesaid "Magenta Toner 5", except that no quinacridone pigment was added. Comparative "Magenta Toner 21" was prepared in the same manner as the aforesaid "Magenta Toner 5", except that neither dye nor metal compound was added.

(Preparation of "Magenta Toners 22")

Inventive Magenta Toner 22 was prepared in the same manner as preparation of Magenta Toner 4 except that Paraffin wax "HNP-57 (produced by Nippon Seiro Co., Ltd) was replaced with the following combination of two waxes in the preparation step of (b) Second Step Polymerization. The waxes used for preparing Magenta Toner 22 instead of Paraffin wax HNP-57 are as follows:

| | |
|---|---|
| Microcrystalline wax HNP-0190 (produced by Nippon Seiro Co., Ltd) | 10.0 parts by weight |
| Ester wax (1B-2) | 83.0 parts by weight. |

In Table 1, listed are the dyes represented by Formula (X-1), the metal compounds represented by Formula (1), and quinacridone pigments represented by Formula (2), all of which were employed to prepare "Magenta Toners 1-21".

TABLE 1

| | | Dye | | Metal Compound | | Quinacridone Pigment | |
|---|---|---|---|---|---|---|---|
| Magenta Toner No. | Production Method | Compound | Added Amount | Compound | Added Amount | Compound | Added Amount |
| 1 | pulverization method | DX-2 | 3.0 | 1-2 | 3.4 | 2-1 | 7.0 |
| 2 | pulverization method | DX-2 | 3.0 | 1-2 | 3.4 | — | — |
| 3 | pulverization method | — | — | — | — | 2-1 | 7.0 |
| 4 | *1 | DX-1 | 20.0 | 1-20 | 17.5 | 2-6 | 8.0 |
| 5 | *1 | DX-3 | 21.0 | 1-1 | 25.0 | 2-3 | 11.0 |
| 6 | *1 | DX-4 | 22.0 | 1-6 | 20.0 | 2-10 | 10.0 |
| 7 | *1 | DX-5 | 18.0 | 1-36 | 22.0 | 2-1 | 7.0 |
| 8 | *1 | DX-6 | 20.5 | 1-3 | 18.0 | 2-4 | 9.5 |
| 9 | *1 | DX-7 | 19.5 | 1-14 | 20.5 | 2-3 | 12.0 |
| 10 | *1 | DX-8 | 20.0 | 1-17 | 22.0 | 2-2 | 10.5 |
| 11 | *1 | DX-10 | 15.0 | 1-8 | 18.0 | 2-5 | 9.0 |
| 12 | *1 | DX-11 | 16.0 | 1-23 | 20.5 | 2-9 | 8.5 |
| 13 | *1 | DX-12 | 17.5 | 1-10 | 19.5 | 2-2 | 7.0 |
| 14 | *1 | DX-13 | 25.0 | 1-30 | 20.0 | 2-1 | 9.5 |
| 15 | *1 | DX-15 | 12.5 | 1-33 | 15.0 | 2-4 | 11.5 |
| 16 | *1 | DX-17 | 18.0 | 1-5 | 16.0 | 2-8 | 10.0 |
| 17 | *1 | DX-19 | 16.0 | 1-11 | 17.5 | 2-5 | 12.0 |
| 18 | *1 | DX-20 | 20.0 | 1-21 | 25.0 | 2-11 | 9.0 |
| 19 | *1 | DX-22 | 20.5 | 1-38 | 20.5 | 2-7 | 8.0 |
| 20 | *1 | DX-3 | 21.0 | 1-1 | 25.0 | — | — |
| 21 | *1 | — | — | — | — | 2-3 | 11.0 |

*1: mini-emulsion polymerization aggregation method

3. Evaluation Experiments

During evaluation, a fixing apparatus composed of the heat roller and the pressure belt shown in FIG. 3 was set in a commercial digital color copier "bizhub Pro C6500 (produced by Konica Minolta Business Technologies, Inc." under the following conditions and loaded.

Heat roller: roller covered with a 30 μm thick tetrafluoroethylene on the surface of an iron cylinder Pressure belt: a belt covered with a 200 μm thick silicone rubber which is prepared by dispersing electrically conductive materials onto a 70 μm thick polyimide film Heat source: halogen lamp Surface temperature of heat roller=140° C.

Pressure between the heat roller and the pressure belt=15 kg

Nip width: 15 mm

Each of the magenta toners shown in Table 1 was loaded in the aforesaid copier, while as the other toners were loaded commercial ones. In an ambience of a temperature of 20° C. and a relative humidity of 50%, the color gamut area, lightfastness, and low temperature offsetting properties were evaluated. Those employing "Magenta Toners 1 and 4-19 were designated as "Examples 1-17, respectively, while those employing "Magenta Toners 2, 3, 20, and 21 were designated as "Comparative Examples 1-4, respectively.

<Determination of Color Gamut>

By employing the aforesaid "bizhub Pro C6500 (produced by Konica Minolta Business Technologies Inc.), a test chart for the color gamut measurement was outputted in a default mode, and the outputted color chart for the color gamut measurement was determined via "SPECTROLINA/SCAN BUNDLE (produced by Gretag Macbeth Co.). The color gamut was determined under the following conditions:

Measurement Conditions

Light source: D50 light source

Observing view: 2°

Density: ANSI T

White standard: Abs

Filter: UV Cut

Measurement mode: reflectance

Language: Japanese

Incidentally, the determination and evaluation of the color gamut was carried out as follows. Each of the solid images (2 cm×2 cm) of monochromatic yellow (Y), monochromatic magenta (M), and monochromatic cyan (C), as well as red (R), blue (B), and green (G) was prepared. The color gamut composed of Y/M/C/R/G/B was represented on a*-b* coordinates, and the resulting area was determined as the color gamut area. The color reproduction range was evaluated while the color gamut area prepared by Comparative Example 1 was 100.

<Lightfastness>

Samples prepared in the same manner as in the aforesaid "color gamut determination" were irradiated for 14 days in a xenon fade meter, and the initial color gamut and the color gamut after 14 days were determined via the same procedures as the aforesaid "color gamut determination". Table 2 shows the results. Any of the images prepared by the magenta toner incorporating no quinacridone resulted in a decrease in color gamut.

<Low Temperature Offsetting Properties>

The fixing apparatus of the aforesaid evaluation copier was modified so that the temperature of the fixing can be controlled and can be measured. In an ambience of a temperature of 30° C. and a relative humidity of 80%, by employing a full-color image in which each of Y, M, C, and Bk was 5% pixel, evaluation was carried out employing the above copier, and the formation of fixing stain was evaluated.

In a single sheet intermittent mode (5-second stop), 100,000 sheets of A4 size were printed. Formation of toner stain on the front and rear surface of the first image and the 100,000th solid white image was visually evaluated as follows. Namely:

A: no stain was noted

B: slight 1-3 stain spots were noted

C: stain was clearly noted Table 2 shows the results.

TABLE 2

| | Magenta Toner No. | Color Gamut Area | Color Gamut Area (after 14 days of lightfastness test) | Low Temperature Offsetting (initial) | Low Temperature Offsetting (100,000th sheet) |
|---|---|---|---|---|---|
| Example 1 | 1 | 125 | 121 | A | A |
| Example 2 | 4 | 129 | 122 | A | A |
| Example 3 | 5 | 125 | 120 | A | A |
| Example 4 | 6 | 127 | 122 | A | A |
| Example 5 | 7 | 130 | 123 | A | A |
| Example 6 | 8 | 124 | 119 | A | A |
| Example 7 | 9 | 128 | 121 | A | A |
| Example 8 | 10 | 125 | 120 | A | A |
| Example 9 | 11 | 128 | 122 | A | A |
| Example 10 | 12 | 129 | 123 | A | A |
| Example 11 | 13 | 130 | 124 | A | A |
| Example 12 | 14 | 125 | 121 | A | A |
| Example 13 | 15 | 125 | 120 | A | A |
| Example 14 | 16 | 123 | 118 | A | A |
| Example 15 | 17 | 128 | 121 | A | A |
| Example 16 | 18 | 127 | 121 | A | A |
| Example 17 | 19 | 129 | 122 | A | A |
| Comparative Example 1 | 2 | 128 | 45 | A | C |
| Comparative Example 2 | 3 | 100 | 99 | A | A |
| Comparative Example 3 | 20 | 127 | 33 | A | C |
| Comparative Example 4 | 21 | 98 | 97 | A | A |

As shown in Table 2, in any of "Examples 1-17" employing the magenta toners having the constitution of the present invention, targeted results were obtained, while in "Comparative Examples 1-4" which did not satisfy the constitution of the present invention, no targeted results were obtained.

Magenta Toner 22 was subjected to the evaluation of "wax unevenness" in a solid image produced by bizhub Pro C6500 (produced by Konica Minolta Business Technologies, Inc.). It was found that any wax unevenness was observed when Magenta Toner 22 was used for forming a solid image.

What is claimed is:

1. A toner comprising:

toner particles containing a binder resin and coloring matters, wherein the coloring matters comprise a dye represented by Formula (X-1), a metal compound represented by Formula (1) and a quinacridone pigment represented by Formula (2) and a total amount of the dye represented by Formula (X-1), the metal compound represented by Formula (1) and the quinacridone pigment represented by Formula (2) is 2-20 mass % based on the total mass of toner;

Formula (X-1)

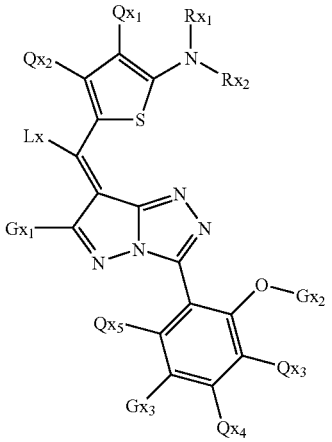

wherein $Rx_1$ and $Rx_2$ each independently represent an alkyl group; Lx represents a hydrogen atom or an alkyl group; $Gx_1$ represents an alkyl group of 2 or more carbon atoms; $Gx_2$ represents an alkyl group or an aromatic hydrocarbon; $Gx_3$ represents a hydrogen atom, a halogen atom, $Gx_4$ —CO—NH—, or $Gx_5$ —N($Gx_6$)-CO—, provided that $Gx_4$ is a substituent, and $Gx_5$ and $Gx_6$ each independently represents a hydrogen atom or a substituent; and $Qx_1$, $Qx_2$, $Qx_3$, $Qx_4$, and $Qx_5$ each independently represents a hydrogen atom or a substituent, Formula (1)

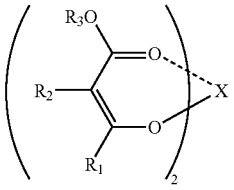

wherein $R_1$ and $R_2$ each independently represent hydrogen atom, an alkyl group, an alkenyl group, a alkynyl group, an aryl group, a heterocyclic group, an alkoxycarbonyl group, an aryloxycarbonyl group, a sulfamoyl group, a sulfinyl group, an alkylsulfonyl group, a arylsulfonyl group, a cyano group, a trifluoroalkyl group or a nitro group, provided that one of $R_1$ and $R_2$ is an electron withdrawing group; $R_3$ represents an alkyl group, an alkenyl group, an alkynyl group, an aryl group or a heterocyclic group, provided that a group represented by $R_3$ contains 3 carbon atoms or more; X represents Cu, Ni, or Co, Formula (2)

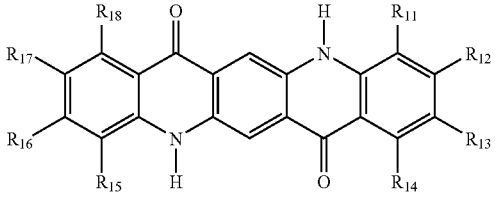

wherein $R_{11}$ to $R_{18}$ each independently represent a hydrogen atom, an alkyl group, a halogen atom or a methoxy group.

2. The toner of claim 1, wherein $GX_1$ in Formula (X-1) is a tert-butyl group.

3. The toner of claim 2, wherein $Qx_1$, $Qx_2$, $Qx_3$, $Qx_4$, and $Qx_5$ in Formula (X-1) are a hydrogen atom.

4. The toner of claim 3, wherein $Gx_2$ is a methyl group or an ethyl group.

5. The toner of claim 1, wherein X in Formula (1) is Cu.

6. The toner of claim 1, wherein the quinacridone pigment represented by Formula (2) is at least one selected from the following compounds (2-1), (2-2) and (2-3):

(2-1)

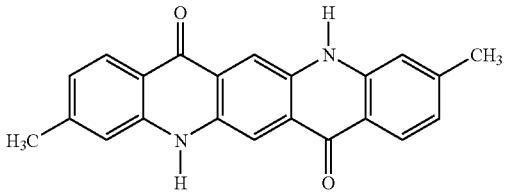

(2-2)

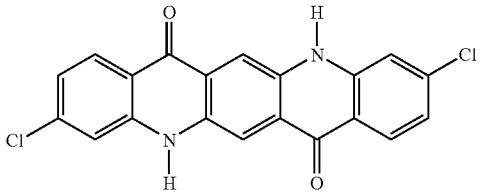

(2-3)

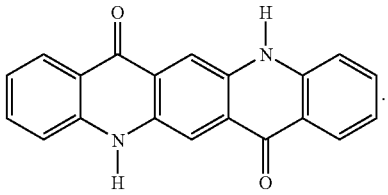

7. The toner of claim 1, wherein a mass ratio of a combination of the dye represented by Formula (X-1) and the metal compound represented by Formula (1) to the quinacridone pigment represented by Formula (2) is between 100:5 and 100:150.

8. The toner of claim 1, wherein the dye represented by Formula (X-1), the metal compound represented by Formula (1) and the quinacridone pigment represented by Formula (2) each are contained in an amount of 0.5-10 mass % based on the total mass of the toner.

9. The toner of claim 1, wherein the dye represented by Formula (X-1), the metal compound represented by Formula (1) and the quinacridone pigment represented by Formula (2) each are contained in an amount of 1-7 mass % based on the total mass of the toner.

* * * * *